US011579559B2

(12) United States Patent
Yamaguchi et al.

(10) Patent No.: US 11,579,559 B2
(45) Date of Patent: Feb. 14, 2023

(54) IMAGE FORMING APPARATUS INCLUDING DEVELOPING CARTRIDGE

(71) Applicant: Brother Kogyo Kabushiki Kaisha, Nagoya (JP)

(72) Inventors: Wataru Yamaguchi, Nisshin (JP); Yasuhiro Hosokawa, Aichi (JP); Yohei Hashimoto, Nagakute (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/452,083

(22) Filed: Oct. 25, 2021

(65) Prior Publication Data

US 2022/0137547 A1 May 5, 2022

(30) Foreign Application Priority Data

Oct. 30, 2020 (JP) ..... JP2020-182576
Feb. 3, 2021 (JP) ..... JP2021-016078

(51) Int. Cl.
*G03G 21/16* (2006.01)
*G03G 21/18* (2006.01)

(52) U.S. Cl.
CPC ..... *G03G 21/1647* (2013.01); *G03G 21/1671* (2013.01); *G03G 21/1825* (2013.01); *G03G 21/1853* (2013.01); *G03G 2221/1654* (2013.01)

(58) Field of Classification Search
CPC ..... G03G 21/1647; G03G 21/1671; G03G 21/1676; G03G 21/1825; G03G 21/1853; G03G 2221/1654
See application file for complete search history.

(56) References Cited

U.S. PATENT DOCUMENTS

2014/0093273 A1 4/2014 Hayakawa et al.
2014/0093279 A1* 4/2014 Hayakawa ..... G03G 21/1676 399/117

FOREIGN PATENT DOCUMENTS

JP 2014-071363 A 4/2014

* cited by examiner

*Primary Examiner* — Sophia S Chen
(74) *Attorney, Agent, or Firm* — Burr Patent Law, PLLC

(57) ABSTRACT

An image forming apparatus includes a housing, a drum cartridge, a developing cartridge including a developing roller and movable between a contact position and a spaced position, a first spacing member configured to move the developing cartridge between the contact position and the spaced position, a first cam configured to move the first spacing member, and a lock member movable between a lock position at which the photoconductive drum is locked to the housing and a lock releasing position at which the lock of the photoconductive drum with respect to the housing is released. The lock member is configured to move from the lock releasing position to the lock position by being pushed by the first spacing member.

25 Claims, 28 Drawing Sheets

IMAGE FORMING APPARATUS INCLUDING DEVELOPING CARTRIDGE

CROSS REFERENCE TO RELATED APPLICATION

The present application claims priorities from Japanese Patent Application Nos. 2020-182576 and 2021-016078, which were respectively filed on Oct. 30, 2020 and Feb. 3, 2021, the disclosures of which are herein incorporated by references in their entireties.

BACKGROUND

The present disclosure relates to an image forming apparatus.

There have been known an image forming apparatus includes, a housing, a drum cartridge having a photoconductive drum, a developing cartridge having a developing roller, a spacing member, a lock member, a link member, and a cam. The developing cartridge is movable between a contact position at which the developing roller contacts the photoconductive drum and a spaced position at which the developing roller is spaced apart from the photoconductive drum. The spacing member moves the developing cartridge between the contact position and the spaced position. The lock member is movable between a lock position at which the photoconductive drum is locked to the housing and a lock releasing position at which the lock of the photoconductive drum with respect to the housing is released.

The lock member and the link member are located on the opposite side of the spacing member with respect to the photoconductive drum. The spacing member moves by being pushed by the cam, and moves the developing cartridge between the contact position and the spaced position. The link member moves by being pushed by the cam, and moves the lock member between the lock position and the lock releasing position.

SUMMARY

In the above image forming apparatus, there is a case where the spacing member and the lock member are not moved at proper timing due to components with tolerances and/or assembly accuracy of components.

In this case, there is a possibility that the spacing member moves in a state in which the lock member is located at the lock releasing position, and, as a result, it is difficult to stably move the developing cartridge from the contact position to the spaced position.

In view of the above, an aspect of the disclosure relates to an image forming apparatus capable of stably moving the developing cartridge from the contact position to the spaced position in a state in which the photoconductive drum is locked to the housing.

In one aspect of the disclosure, an image forming apparatus includes a housing, a drum cartridge including a photoconductive drum, a developing cartridge including a developing roller and movable between a contact position at which the developing roller contacts the photoconductive drum and a spaced position at which the developing roller is spaced apart from the photoconductive drum, a first spacing member movable with respect to the housing, the first spacing member being configured to move the developing cartridge between the contact position and the spaced position, a first cam configured to move the first spacing member, and a lock member movable between a lock position at which the photoconductive drum is locked to the housing and a lock releasing position at which the lock of the photoconductive drum with respect to the housing is released. The lock member is configured to move from the lock releasing position to the lock position by being pushed by the first spacing member.

In another aspect of the disclosure, an image forming apparatus includes a housing, a drum cartridge including a photoconductive drum, a developing cartridge including a developing roller and movable between a contact position at which the developing roller contacts the photoconductive drum and a spaced position at which the developing roller is spaced apart from the photoconductive drum, a spacing cam movable with respect to the housing, the first spacing cam being configured to move the developing cartridge between the contact position and the spaced position, the spacing cam including a protrusion which has a spacing cam surface, a moving cam configured to move the spacing cam, and a lock member movable between a lock position at which the photoconductive drum is locked to the housing and a lock releasing position at which the lock of the photoconductive drum with respect to the housing is released. The lock member has a lock surface. The lock member is configured to move from the releasing position to the lock position when the spacing surface of the spacing cam pushes the lock surface of the lock member.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 3A illustrates a state in which the developing cartridge is located at a contact position;

EMBODIMENTS

1. Image Forming Apparatus 1

There will be described an image forming apparatus 1 as a first embodiment in the present disclosure with reference to FIG. 1.

Figure 1:
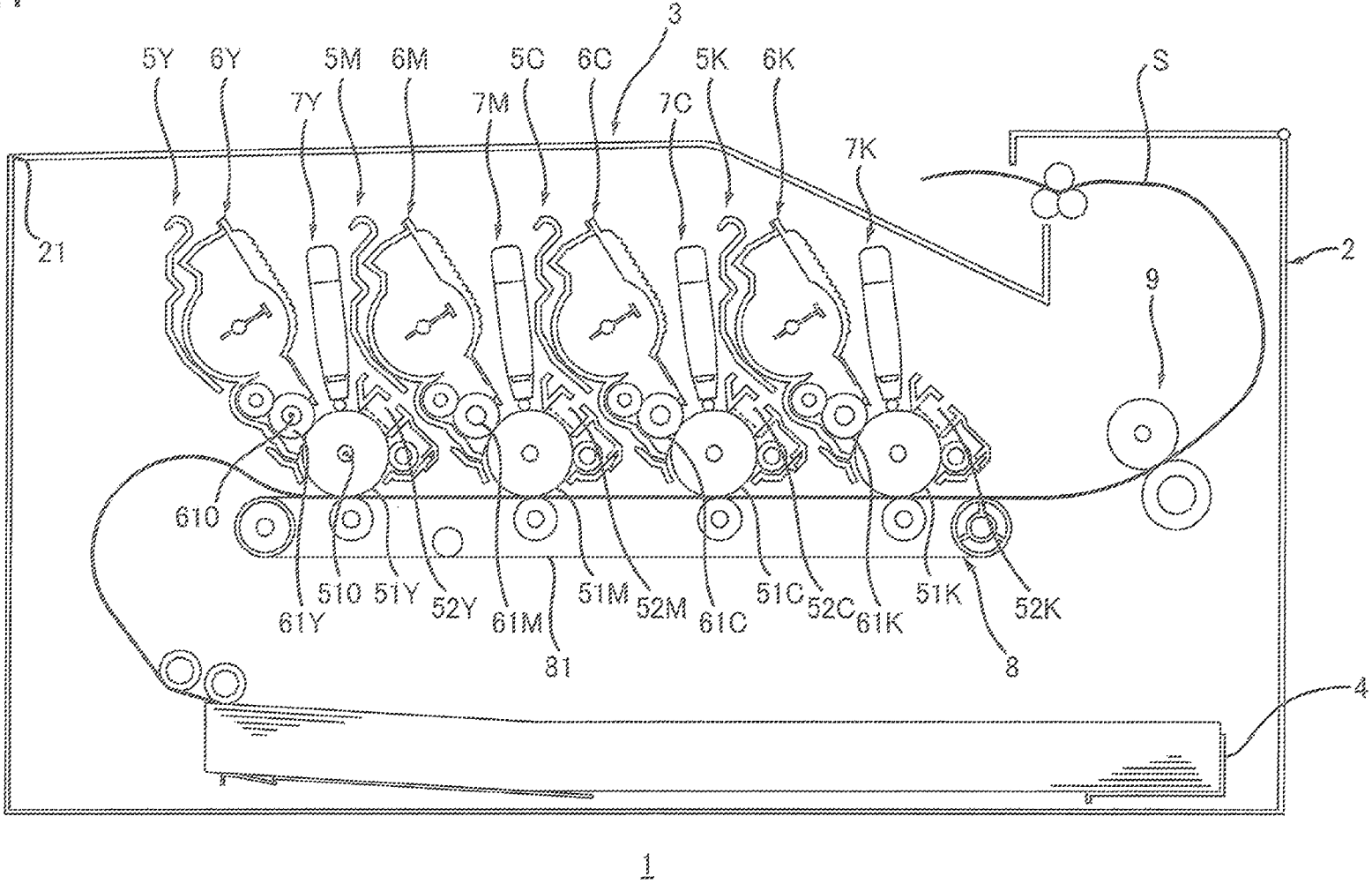
FIG. 1 is a schematic structural view of an image forming apparatus, illustrating a state in which a cover is located at a closed position.

As illustrated in FIG. 1, the image forming apparatus 1 includes a housing 2, a cover 3, a sheet cassette 4, four drum cartridges 5Y, 5M, 5C, and 5K, four exposing devices 7Y, 7M, 7C, and 7K, and four developing cartridges 6Y, 6M, 6C, and 6K, a transfer device 8, and a fixing device 9.

1.1 Housing 2

The housing 2 accommodates the sheet cassette 4, the four drum cartridges 5Y, 5M, 5C, and 5K, the four exposing devices 7Y, 7M, 7C, and 7K, the four developing cartridges 6Y, 6M, 6C, and 6K, the transfer device 8, and the fixing device 9.

The housing 2 includes an opening 21. The opening 21 is located at an upper end of the housing 2.

1.2 Cover 3

The cover 3 opens and closes the opening 21. The cover 3 is movable between a closed position (see FIG. 1) and an open position (see FIG. 2). The cover 3 closes the opening 21 in a state in which the cover 3 is located at the closed position. The opening 21 is opened in a state in which the cover 3 is located at the open position. The cover 3 is rotatably supported by the housing 2.

1.3 Sheet Cassette 4

The sheet cassette 4 is capable of accommodating a sheet S. The sheet S inside the sheet cassette 4 is conveyed toward a photoconductive drum 51Y of the drum cartridge 5Y. The photoconductive drum 51Y will be explained later.

1.4 Four Drum Cartridges 5Y, 5M, 5C, 5K

The drum cartridge 5Y includes the photoconductive drum 51Y and a charging device 52Y.

The photoconductive drum 51Y extends in a first direction. The first direction intersects a vertical direction. The photoconductive drum 51Y has a cylindrical shape. The photoconductive drum 51Y is rotatable about a drum axis 510. The drum axis 510 extends in the first direction.

The charging device 52Y charges a peripheral surface of the photoconductive drum 51Y. Specifically, the charging device 52Y is a scorotron type charging unit. The charging device 52Y may be a charging roller.

Figure 2:
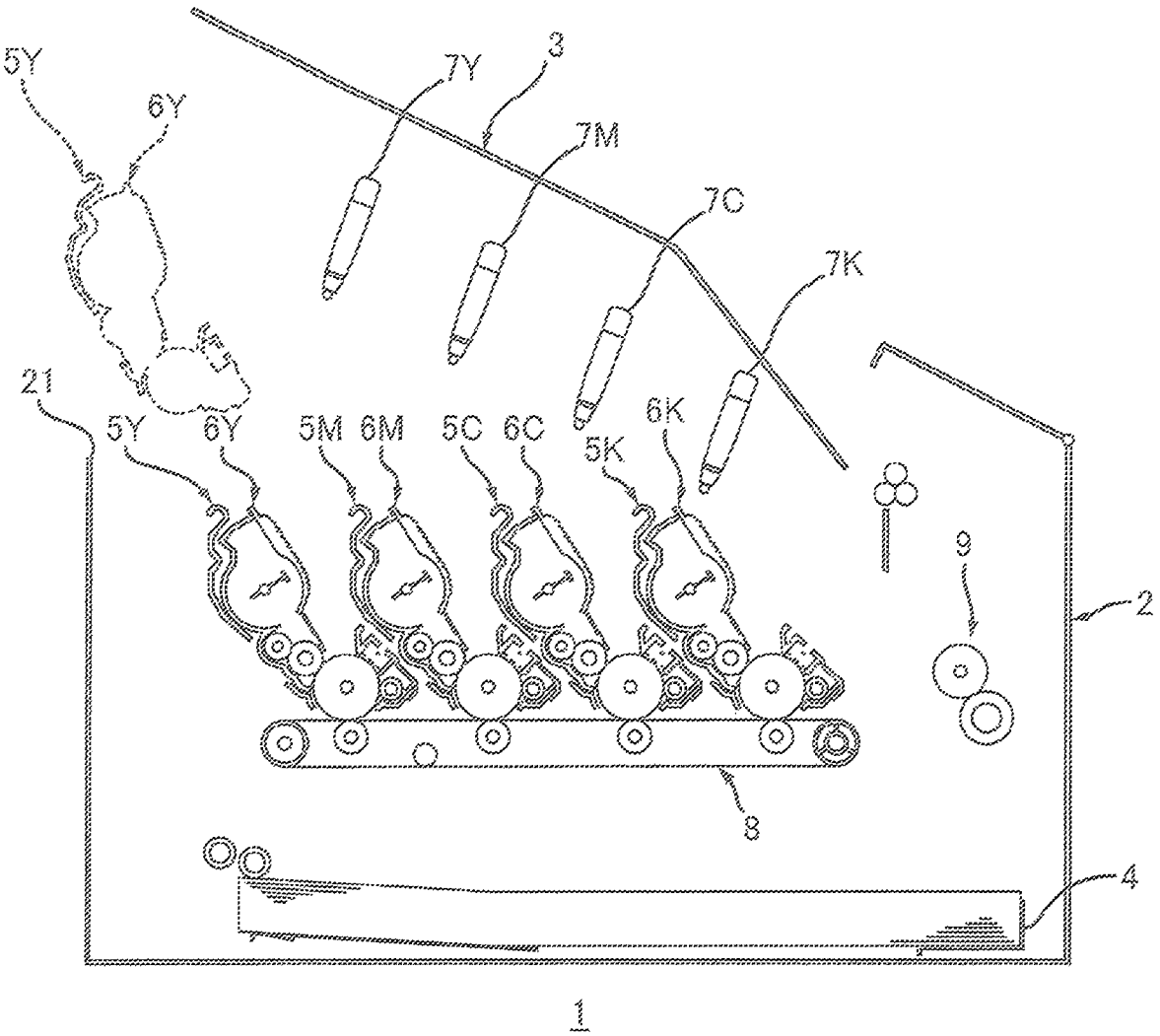
FIG. 2 is a schematic structural view of the image forming apparatus illustrated in FIG. 1, illustrating a state in which the cover is place at an open position.

The drum cartridge 5Y is mountable/detachable on/from the housing 2 through the opening 21 in the state in which the cover 3 is located at the open position (see FIG. 2).

The drum cartridges 5M, 5C, and 5K will be explained similarly to the drum cartridge 5Y. Therefore, explanation for the drum cartridges 5M, 5C, and 5K is omitted.

The drum cartridge 5M includes a photoconductive drum 51M and a charging device 52M. The drum cartridge 5C includes a photoconductive drum 51C and a charging device 52C. The drum cartridge 5K includes a photoconductive drum 51K and a charging device 52K.

The four drum cartridges 5Y, 5M, 5C, and 5K are arranged in order in a conveying direction of the sheet S by a conveying belt 81 in a state in which the four drum cartridges 5Y, 5M, 5C, and 5K are mounted on the housing 2. The conveying direction intersects the vertical direction and the first direction. The conveying belt 81 will be explained later.

1.5. Four Exposing Devices 7Y, 7M, 7C, 7K

The exposing device 7Y can expose a surface of the photoconductive drum 51Y. Since the exposing device 7Y exposes the surface of the photoconductive drum 51Y in a state in which the surface of the photoconductive drum 51Y is charged, an electrostatic latent image is formed on the surface of the photoconductive drum 51Y. Specifically, the exposing device 7Y is an LED array.

The exposing devices 7M, 7C, and 7K are explained similarly to the exposing device 7Y. Therefore, explanation for the exposing devices 7M, 7C, and 7K is omitted. The exposing device 7M can expose a surface of the photoconductive drum 51M. The exposing device 7C can expose a surface of the photoconductive drum 51C. The exposing device 7K can expose a surface of the photoconductive drum 51K.

1.6 Four Developing Cartridges 6Y, 6M, 6C, 6K

The developing cartridge 6Y is mountable/detachable on/from the drum cartridge 5Y. The developing cartridge 6Y includes a developing roller 61Y. The developing roller 61Y extends in the first direction. The developing roller 61Y is rotatable about a developing axis 610. The developing axis 610 extends in the first direction.

Figure 3A:
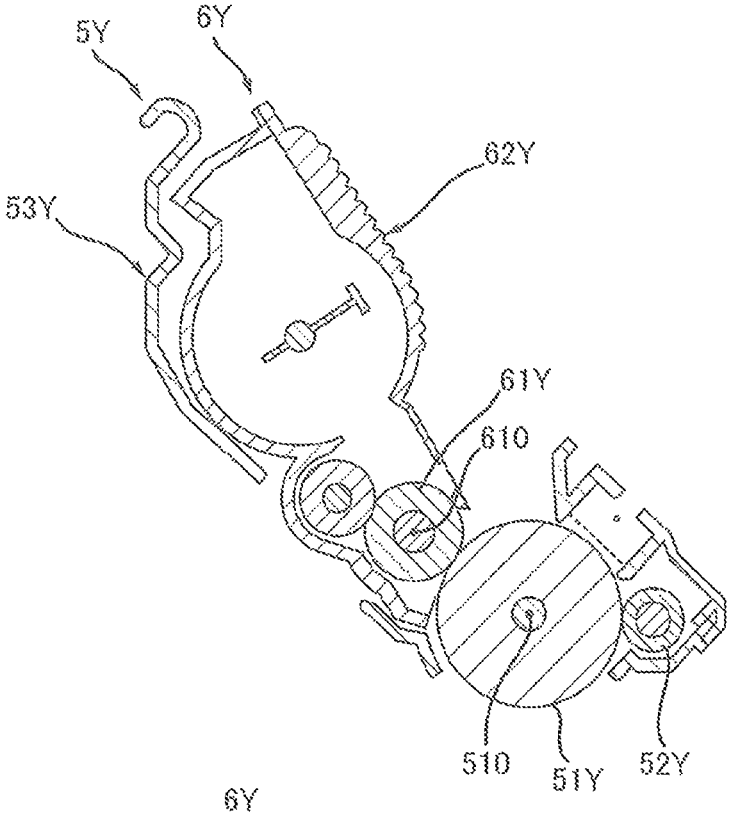
FIG. 3A is a schematic structural view of a drum cartridge and a developing cartridge illustrated in FIG. 1.
Figure 3B:
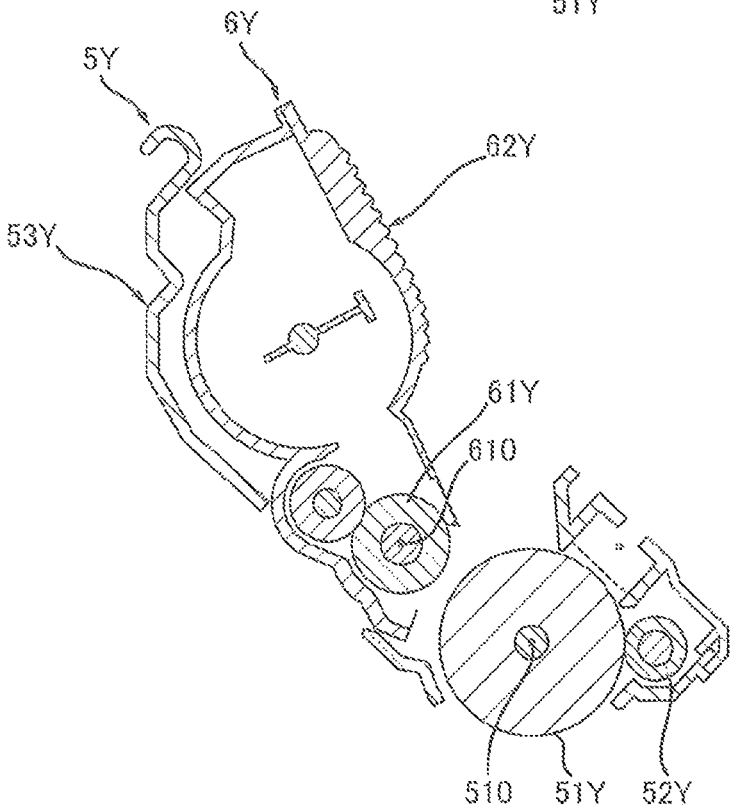
FIG. 3B is a schematic structural view of the drum cartridge and the developing cartridge illustrated in FIG. 1, illustrating a state in which the developing cartridge is located at a spaced position.

As illustrated in FIG. 3A and FIG. 3B, the developing cartridge 6Y is movable between a contact position (see FIG. 3A) and a spaced position (see FIG. 3B) in a state in which the developing cartridge 6Y is mounted on the drum cartridge 5Y. The developing roller 61Y is in contact with the photoconductive drum 51Y in a state in which the developing cartridge 6Y is located at the contact position (see FIG. 3A). The developing roller 61Y supplies toner to the photoconductive drum 51Y in the state in which the developing cartridge 6Y is located at the contact position. The developing roller 61Y is spaced apart from the photoconductive drum 51Y in a state in which the developing cartridge 6Y is located at the spaced position (see FIG. 3B).

As illustrated in FIG. 1, the developing cartridges 6M, 6C, and 6K are explained similarly to the developing cartridge 6Y. Therefore, explanation for the developing cartridges 6M, 6C, and 6K is omitted.

The developing cartridge 6M is mountable/detachable on/from the drum cartridge 5M. The developing cartridge 6M includes a developing roller 61M. The developing cartridge 6M is movable between the contact position and the spaced position in a state in which the developing cartridge 6M is mounted on the drum cartridge 5M.

The developing cartridge 6C is mountable/detachable on/from the drum cartridge 5C. The developing cartridge 6C includes a developing roller 61C. The developing cartridge 6C is movable between the contact position and the spaced position in a state in which the developing cartridge 6C is mounted on the drum cartridge 5C.

The developing cartridge 6K is mountable/detachable on/from the drum cartridge 5K. The developing cartridge 6K includes a developing roller 61K. The developing cartridge 6K is movable between the contact position and the spaced position in a state in which the developing cartridge 6K is mounted on the drum cartridge 5K.

1.7 Transfer Device 8

The transfer device 8 includes the conveying belt 81. The conveying belt 81 conveys the sheet S supplied from the sheet cassette 4 toward the fixing device 9. The sheet S conveyed by the conveying belt 81 passes between the transfer device 8 and the four photoconductive drums 51Y, 51M, 51C, and 51K. At this time, the transfer device 8 transfers toner formed on the four photoconductive drums 51Y, 51M, 51C, and 51K onto the sheet S.

1.8 Fixing Device 9

The fixing device 9 heats and pressurizes the sheet S onto which toner is transferred to thereby fix the toner on the sheet S. The sheet S which has passed through the fixing device 9 is discharged to an upper surface of the housing 2.

2. Details of Drum Cartridge 5Y

There will be described next the details of the drum cartridge 5Y with reference to FIG. 3A to FIG. 7.

Figure 7:
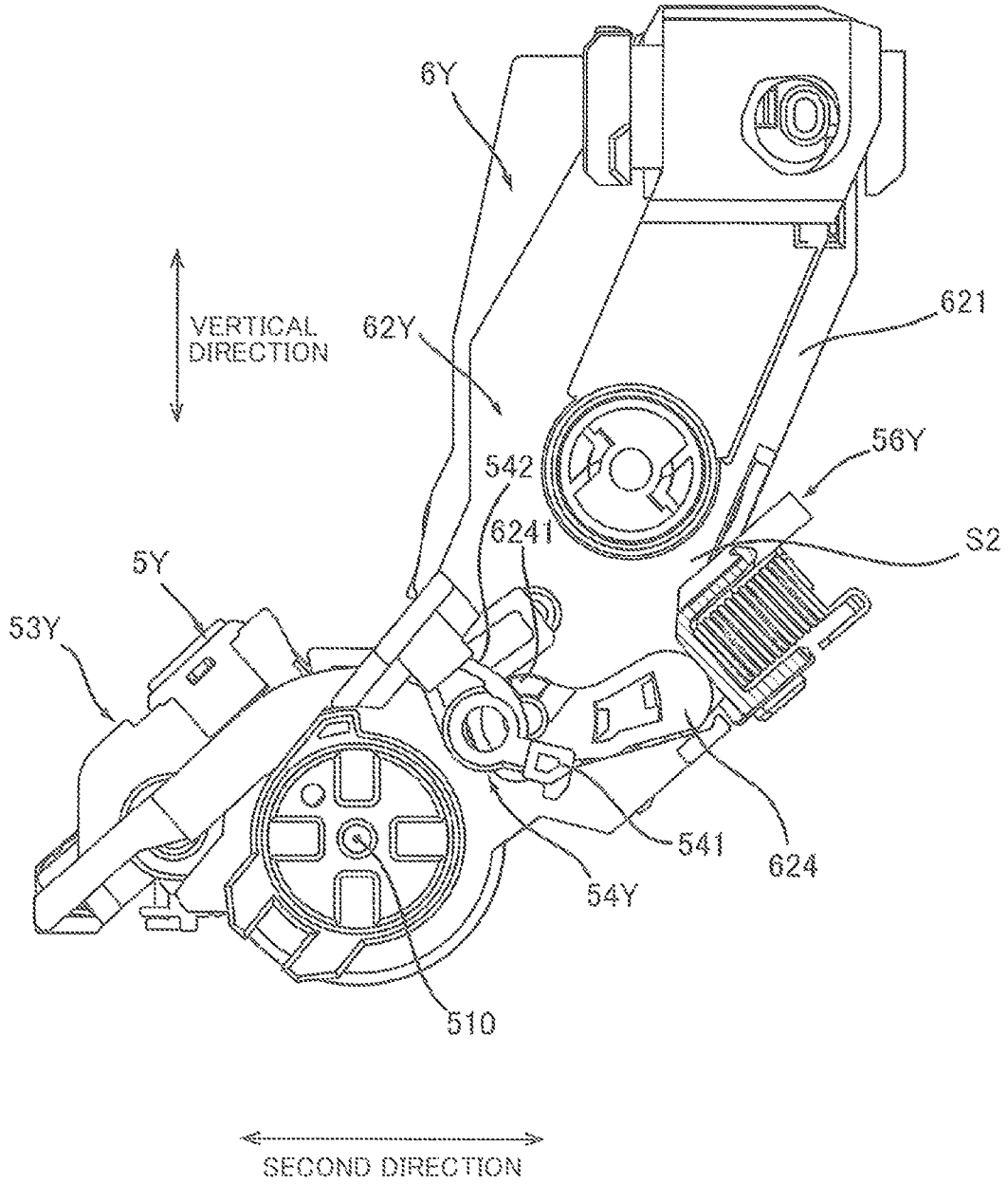
FIG. 7 is the other side view of the drum cartridge and the developing cartridge illustrated in FIG. 6, illustrating a state in which a second side wall is removed.

The drum cartridge 5Y includes, in addition to the above photoconductive drum 51Y (see FIG. 3A) and the above charging device 52Y (see FIG. 3A), a drum frame 53Y (see FIG. 4), a pivoting member 54Y (see FIG. 7), a pressing member 55Y (see FIG. 5), and a pressing member 56Y (see FIG. 7).

2.1 Drum Frame 53Y

Figure 6:
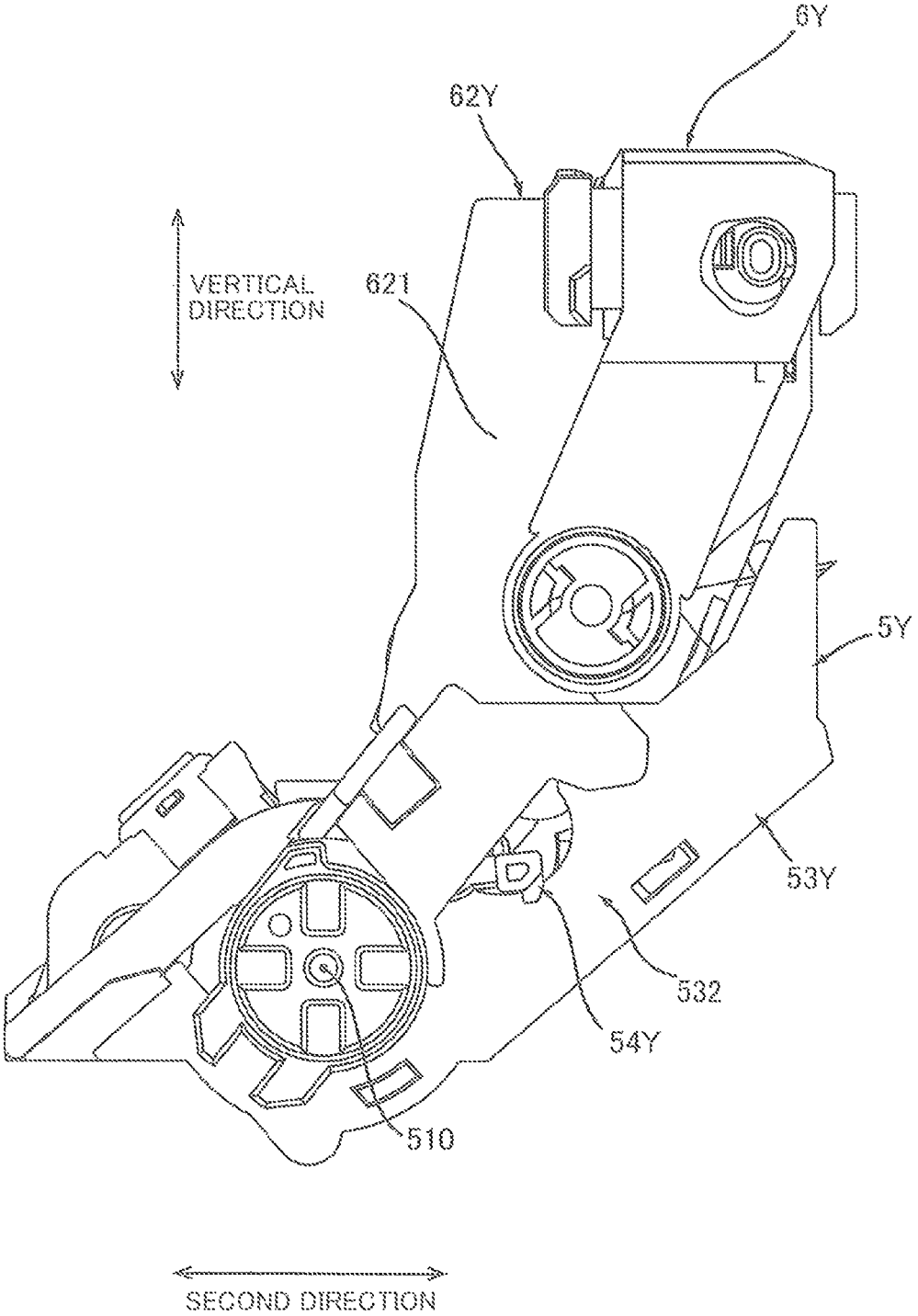
FIG. 6 is the other side view of the drum cartridge and the developing cartridge illustrated in FIG. 3A.

As illustrated in FIG. 3A, the drum frame 53Y supports the photoconductive drum 51Y and the charging device 52Y. The developing cartridge 6Y is mountable/detachable on/from the drum frame 53Y As illustrated in FIG. 4 and FIG. 6, the drum frame 53Y includes a first side wall 531 (see FIG. 4) and a second side wall 532 (see FIG. 6).

2.1.1 First Side Wall 531

Figure 4:
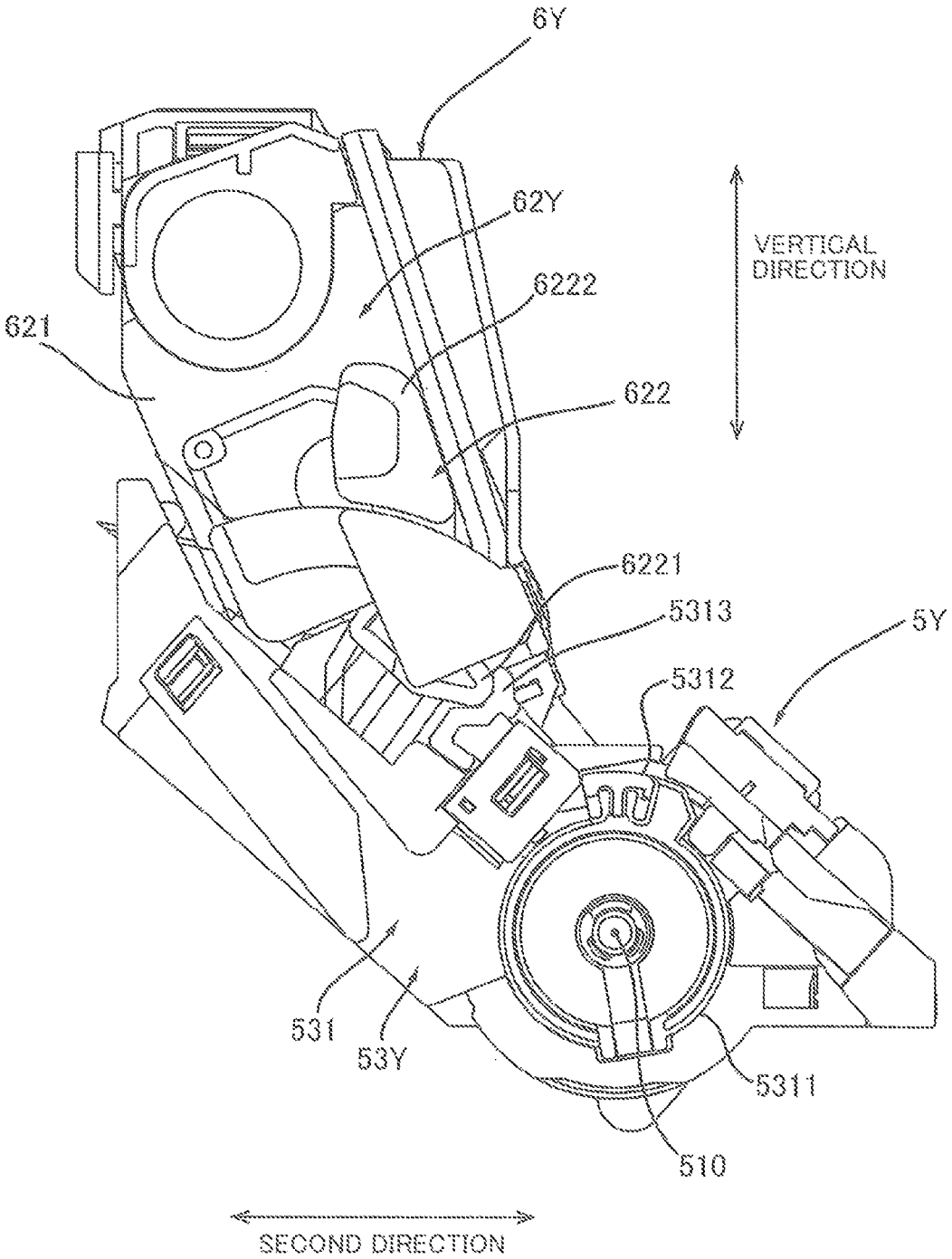
FIG. 4 is a one side view of the drum cartridge and the developing cartridge illustrated in FIG. 3A.

As illustrated in FIG. 4, the first side wall 531 is located at one end of the drum frame 53Y in the first direction. The first side wall 531 includes a bearing 5311, a second protrusion 5312, and a first contact portion 5313. In other words, the drum cartridge 5Y includes the bearing 5311, the second protrusion 5312, and the first contact portion 5313.

Figure 5:
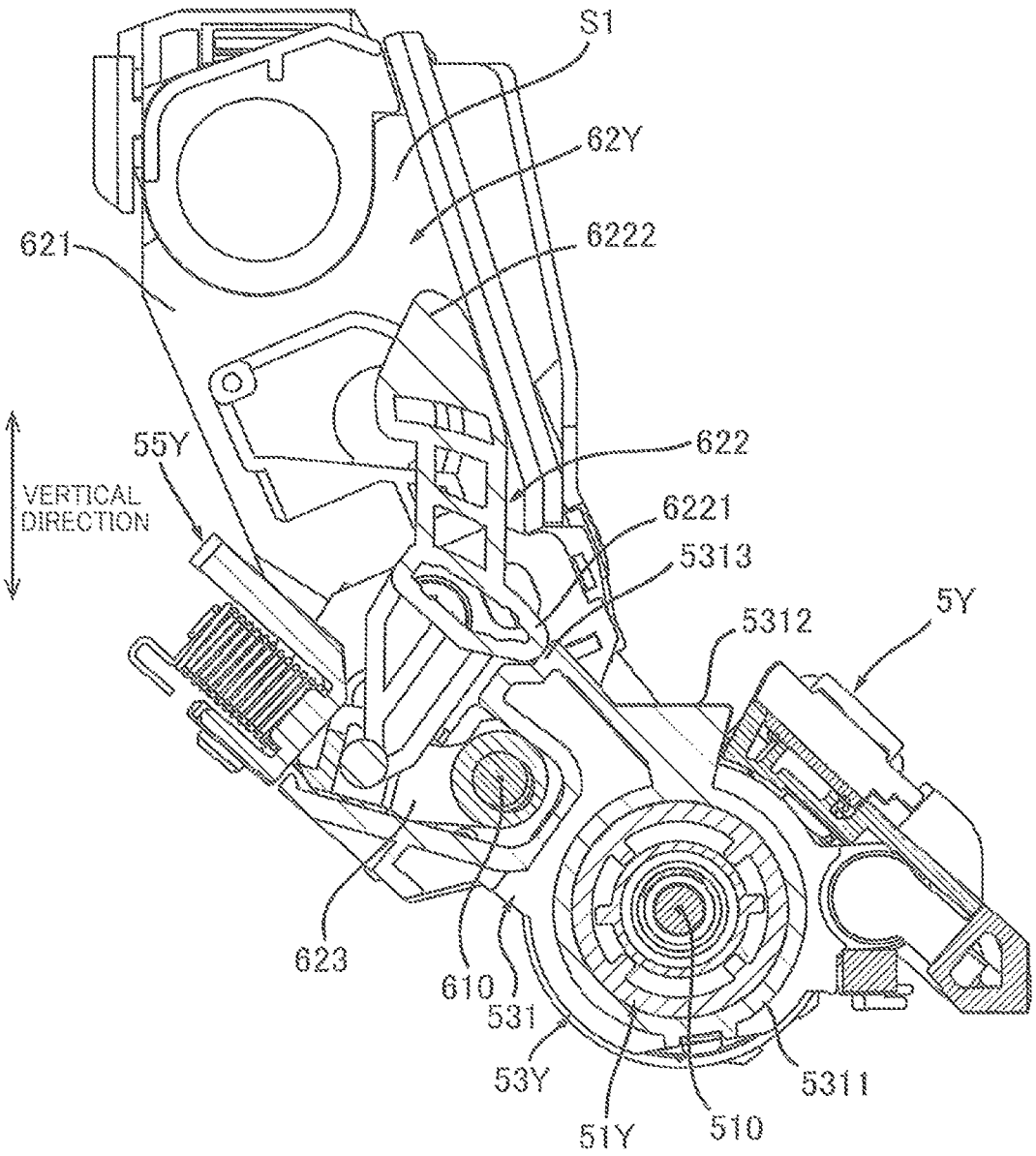
FIG. 5 illustrates a cross-sectional side view of a first side wall and an arm illustrated in FIG. 4.

As illustrated in FIG. 5, the bearing 5311 supports one end of the photoconductive drum 51Y in the first direction. The one end of the photoconductive drum 51Y in the first direction is fitted into the bearing 5311. The bearing 5311 has a cylindrical shape. The bearing 5311 extends in the first direction.

The second protrusion 5312 is in contact with a first protrusion 1822 included in a first lock member 18Y in a state in which the first lock member 18Y is located at a lock position. The first lock member 18Y will be explained later. The second protrusion 5312 is continued from the bearing 5311. The second protrusion 5312 protrudes from the bearing 5311 in a radial direction of the bearing 5311. The second protrusion 5312 extends in the first direction. The second protrusion 5312 is located at an upper position than the bearing 5311 in a state in which the drum cartridge 5Y is mounted on the housing 2. The upper position means an upper position in a gravity direction at the time of placing the image forming apparatus 1 in a normal use state.

The first contact portion 5313 is contactable with an arm 622 included in the developing cartridge 6Y in the state in which the developing cartridge 6Y is mounted on the drum cartridge 5Y. The arm 622 will be explained later. The first contact portion 5313 is continued from the second protrusion 5312. The first contact portion 5313 extends in the first direction. The first contact portion 5313 extends from the second protrusion 5312 toward an upper diagonal direction in a state in which the drum cartridge 5Y is mounted on the housing 2.

2.1.2 Second Side Wall 532

As illustrated in FIG. 6, the second side wall 532 is located at the other end of the drum frame 53Y in the first direction. The second side wall 532 is located apart from the first side wall 531 (see FIG. 4) in the first direction. The second side wall 532 supports the other end of the photoconductive drum 51Y in the first direction (see FIG. 3A).

2.2 Pivoting Member 54Y

As illustrated in FIG. 7, the pivoting member 54Y is supported by the second side wall 532. The pivoting member 54Y is rotatable about an axis. The axis of the pivoting member 54Y extends in the first direction. The pivoting member 54Y includes a first portion 541 and a second portion 542. The first portion 541 is contactable with a second spacing member 17Y in the state in which the drum cartridge 5Y is mounted on the housing 2. The second spacing member 17Y will be explained later. The second portion 542 is located on the opposite side of the first portion 541 with respect to the axis of the pivoting member 54Y. The second portion 542 is in contact with a protrusion 6241 included in the developing cartridge 6Y in a state in which the first portion 541 is in contact with the second spacing member 17Y. The protrusion 6241 will be explained later.

2.3 Pressing Members 55Y, 56Y

As illustrated in FIG. 5 and FIG. 7, the two pressing members 55Y, 56Y press the developing cartridge 6Y toward the contact position (see FIG. 3A) in the state in which the developing cartridge 6Y is mounted on the drum cartridge 5Y. The two pressing members 55Y, 56Y are supported by the drum frame 53Y. The two pressing members 55Y, 56Y are spaced apart from each other in the first direction. The pressing member 55Y is located on the opposite side of the photoconductive drum 51Y with respect to the first contact portion 5313 (see FIG. 5). The pressing member 56Y is located on the opposite side of the photoconductive drum 51Y with respect to the pivoting member 54Y (see FIG. 7).

3. Details of Developing Cartridge 6Y

There will be described next the details of the developing cartridge 6Y with reference to FIG. 3A to FIG. 7.

The developing cartridge 6Y includes a developing frame 62Y (see FIG. 4) in addition to the above developing roller 61Y (see FIG. 3A).

3.1 Developing Frame 62Y

As illustrated in FIG. 5 and FIG. 7, the developing frame 62Y includes a developing housing 621, the arm 622 (see FIG. 5), a first support portion 623 (see FIG. 5), and a second support portion 624 (see FIG. 7).

The developing housing 621 accommodates toner. The developing housing 621 extends in the first direction. The developing housing 621 is located between the first side wall 531 (see FIG. 5) and the second side wall 532 (see FIG. 6) in the state in which the developing cartridge 6Y is mounted on the drum cartridge 5Y. The developing housing 621 includes a first side surface S1 (see FIG. 5) and a second side surface S2 (see FIG. 7). The first side surface S1 is located at one end of the developing housing 621 in the first direction. The second side surface S2 is located at the other end of the developing housing 621 in the first direction.

As illustrated in FIG. 5, the arm 622 and the developing housing 621 are arranged in the first direction. The arm 622 is located on the first side surface S1 of the developing housing 621. The arm 622 is supported by the developing housing 621. The arm 622 extends in the vertical direction in a state in which the developing cartridge 6Y is mounted on the drum cartridge 5Y and the drum cartridge 5Y is mounted on the housing 2. The arm 622 has a first end portion 6221 and a second end portion 6222.

The first end portion 6221 is located at a lower end of the arm 622 in the state in which the developing cartridge 6Y is mounted on the drum cartridge 5Y and the drum cartridge 5Y is mounted on the housing 2. The first end portion 6221 is in contact with the first contact portion 5313 in the state in which the developing cartridge 6Y is mounted on the drum cartridge 5Y. The first end portion 6221 is located on the opposite side of the drum axis 510 of the photoconductive drum 51Y with respect to the first contact portion 5313 in the state in which developing cartridge 6Y is mounted on the drum cartridge 5Y.

The second end portion 6222 is upwardly spaced apart from the first end portion 6221 in the state in which the developing cartridge 6Y is mounted on the drum cartridge 5Y and the drum cartridge 5Y is mounted on the housing 2. The second end portion 6222 is contactable with a first boss 164 of a first spacing member 16Y (as an example of a spacing cam or a first spacing cam) in the state in which the developing cartridge 6Y is mounted on the drum cartridge 5Y and the drum cartridge 5Y is mounted on the housing 2. The first spacing member 16Y will be explained later.

The first support portion 623 supports one end of the developing roller 61Y (see FIG. 3A) in the first direction. The first support portion 623 and the developing housing 621 are arranged in the first direction. The first support portion 623 is located on the first end surface S1 of the developing housing 621. The first support portion 623 is supported by the developing housing 621. The first support portion 623 is located between the pressing member 55Y and the photoconductive drum 51Y in the state in which the developing cartridge 6Y is mounted on the drum cartridge 5Y. The first support portion 623 is in contact with the pressing member 55Y in the state in which the developing cartridge 6Y is mounted on the drum cartridge 5Y. Accordingly, the pressing member 55Y presses the developing cartridge 6Y toward the contact position (see FIG. 3A).

As illustrated in FIG. 7, the second support portion 624 supports the other end of the developing roller 61Y (see FIG. 3A) in the first direction. The second support portion 624 is located on the opposite side of the first support portion 623 with respect to the developing housing 621 in the first direction. The second support portion 624 is located on the second side surface S2 of the developing housing 621. The second support portion 624 is supported by the developing housing 621. The second support portion 624 is located between the pressing member 56Y and the photoconductive drum 51Y in the state in which the developing cartridge 6Y is mounted on the drum cartridge 5Y. The second support portion 624 is in contact with the pressing member 56Y in the state in which the developing cartridge 6Y is mounted on the drum cartridge 5Y. Accordingly, the pressing member 56Y presses the developing cartridge 6Y toward the contact position together with the pressing member 55Y (see FIG. 3A).

The second support portion 624 includes the protrusion 6241. The protrusion 6241 extends in the first direction. The protrusion 6241 is located between the second portion 542 of the pivoting member 54Y and the pressing member 56Y in the state in which the developing cartridge 6Y is mounted on the drum cartridge 5Y.

4. Details of Housing 2

Next, there will be described the details of the housing 2 with reference to FIG. 8 to FIG. 9B.

Figure 8:
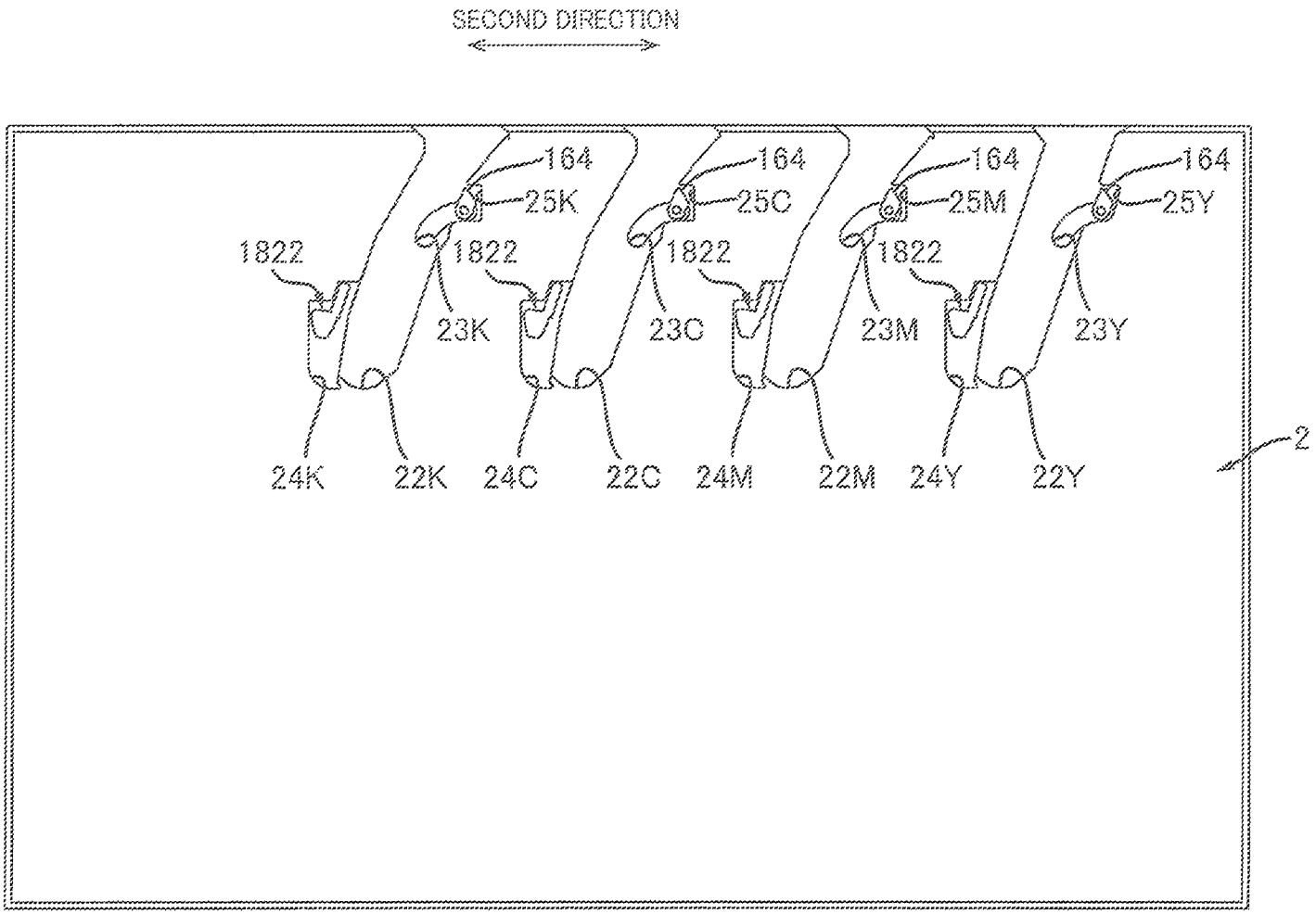
FIG. 8 is a side view of a guide included in a housing illustrated in FIG. 1, illustrating a state in which a first spacing member is located at a third position and a first lock member is located at a lock releasing position.

As illustrated in FIG. 8, the housing 2 includes four guides 22Y, 22M, 22C, and 22K, four grooves 25Y, 25M, 25C, and 25K, four first holes 23Y, 23M, 23C, and 23K, and four second holes 24Y, 24M, 24C, and 24K.

4.1 Four Guides 22Y, 22M, 22C, 22K

The four guides 22Y, 22M, 22C, and 22K are located on a side wall of the housing 2. The four guides 22Y, 22M, 22C, and 22K are arranged in order so as to be spaced apart from one another in a second direction. The second direction intersects the vertical direction and the first direction. The four guides 22Y, 22M, 22C, and 22K have the same structure as one another. Therefore, the guide 22Y will be explained in detail, and explanation for the guides 22M, 22C, and 22K is omitted.

The guide 22Y guides mounting/detachment of the drum cartridge 5Y on/from the housing 2 (see FIG. 2). The guide 22Y is a groove. The guide 22Y extends in the vertical direction.

4.2 Four Grooves 25Y, 25M, 25C, 25K

The four grooves 25Y, 25M, 25C, and 25K are located so as to be spaced apart from one another in the second direction. The four grooves 25Y, 25M, 25C, and 25K have the same structure as one another. Therefore, the groove 25Y will be explained in detail, and explanation for the grooves 25M, 25C, and 25K is omitted.

The groove 25Y is located on the opposite side of the guide 22M with respect to the guide 22Y in the second direction. The groove 25Y communicates with the guide 22Y in the second direction. The groove 25Y is recessed from the guide 22Y in the second direction.

4.3 Four First Holes 23Y, 23M, 23C, 23K

The four first holes 23Y, 23M, 23C, and 23K are located so as to be spaced apart from one another in the second direction. The four first holes 23Y, 23M, 23C, and 23K have the same structure as one another. Therefore, the first hole 23Y will be explained in detail, and explanation for the first holes 23M, 23C, and 23K is omitted.

The first hole 23Y communicates with each of the guide 22Y and the groove 25Y in the first direction. The first hole 23Y extends in a cylindrical shape. The first boss 164 of the first spacing member 16Y passes through the first hole 23Y.

4.4. Four Second Holes 24Y, 24M, 24C, 24K

The four second holes 24Y, 24M, 24C, and 24K are located so as to be spaced apart from one another in the second direction. The second holes 24Y, 24M, 24C, and 24K have the same structure as one another. Therefore, the second hole 24Y will be explained in detail, and explanation for the second holes 24M, 24C, and 24K is omitted.

The second hole 24Y is located on the opposite side of the groove 25Y with respect to the guide 22Y in the second direction. The second hole 24Y and a lower end of the guide 22Y are arranged in the second direction. The first protrusion 1822 of the first lock member 18Y passes through the second hole 24Y.

5. Details of Image Forming Apparatus

Next, there will be described the details of the image forming apparatus 1 with reference to FIG. 10 to FIG. 18.

Figure 10:
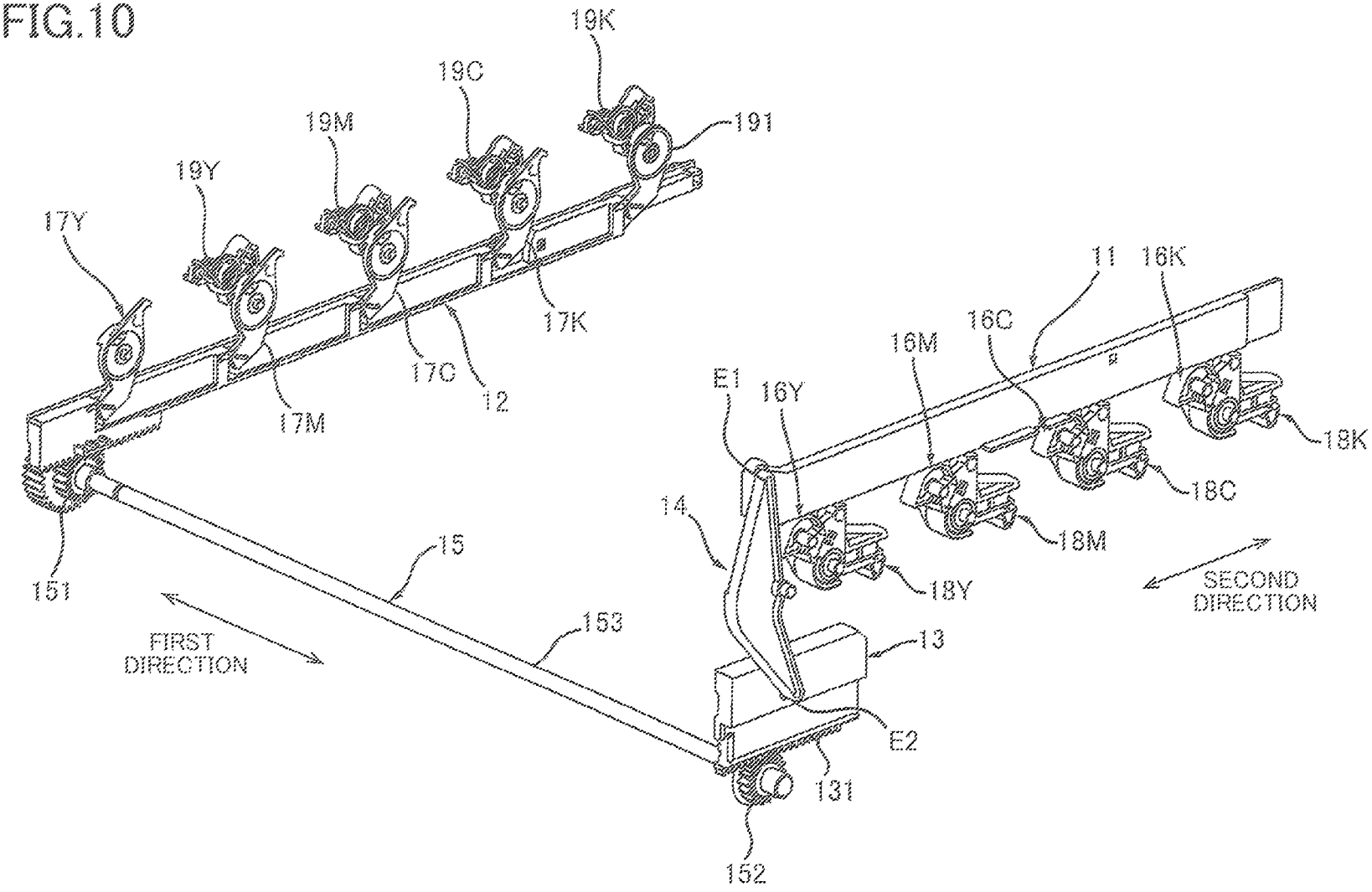
FIG. 10 is a perspective view of the first spacing member, the first lock member, a second spacing member, and a second lock member included in the image forming apparatus illustrated in FIG. 1.

As illustrated in FIG. 10, the image forming apparatus 1 includes four first spacing members 16Y, 16M, 16C, and 16K, four second spacing members 17Y, 17M, 17C, and 17K (each as an example of a second spacing cam), four first lock members 18Y, 18M, 18C, and 18K, four second lock members 19Y, 19M, 19C, and 19K, a first cam 11 (as an example of a moving cam or a first moving cam), a second cam 12 (as example of a second moving cam), an interlocking member 13, a rotating rod 14, and a drive transmission mechanism 15.

5.1 Four First Spacing Members 16Y, 16M, 16C, 16K

The four first spacing members 16Y, 16M, 16C, and 16K are supported by the housing 2. The four first spacing members 16Y, 16M, 16C, and 16K are located so as to be spaced apart from one another in the second direction. The four first spacing members 16Y, 16M, 16C, and 16K have the same structure as one another. Therefore, the first spacing member 16Y will be explained in detail, and explanation for the first spacing members 16M, 16C, and 16K is omitted.

5.1.1 First Spacing Member 16Y

Figure 16A:
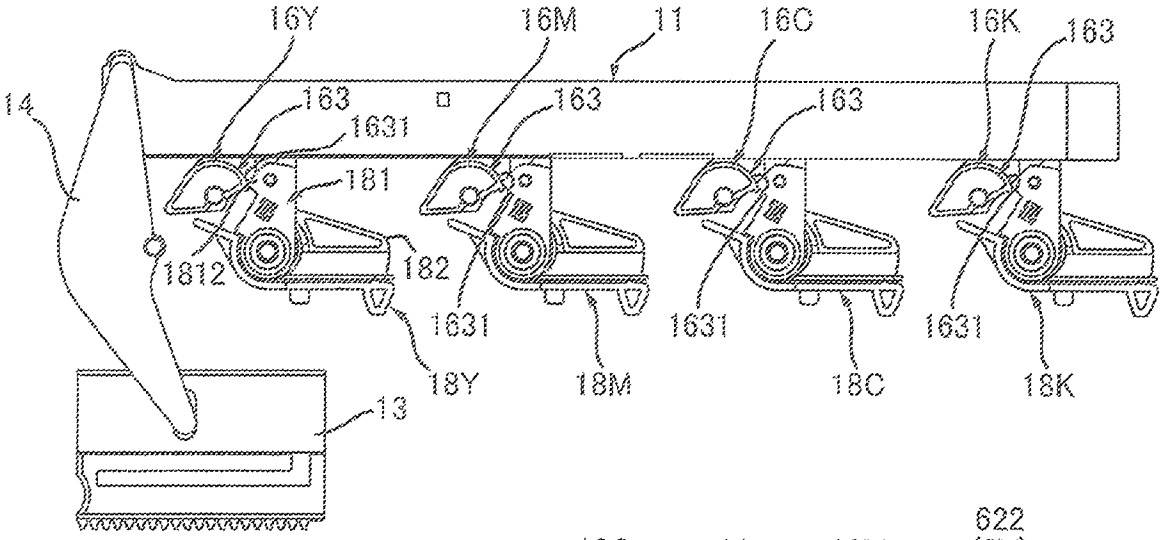
FIG. 16A is one side view of first cam, the first spacing member, and the first lock member illustrated in FIG. 15A, illustrating a state in which the first cam is located at a cam second position.
Figure 16B:
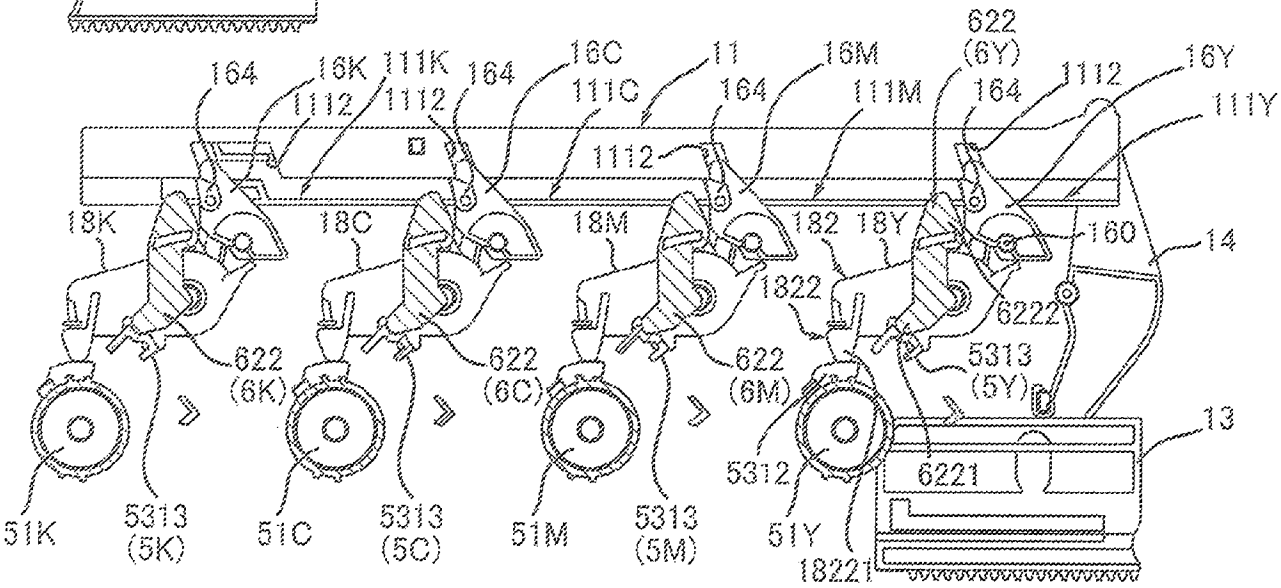
FIG. 16B is the other side view of the first cam, the first spacing member, and the first lock member illustrated in FIG. 15B, illustrating the state in which the first cam is located at the cam second position.
Figure 17A:
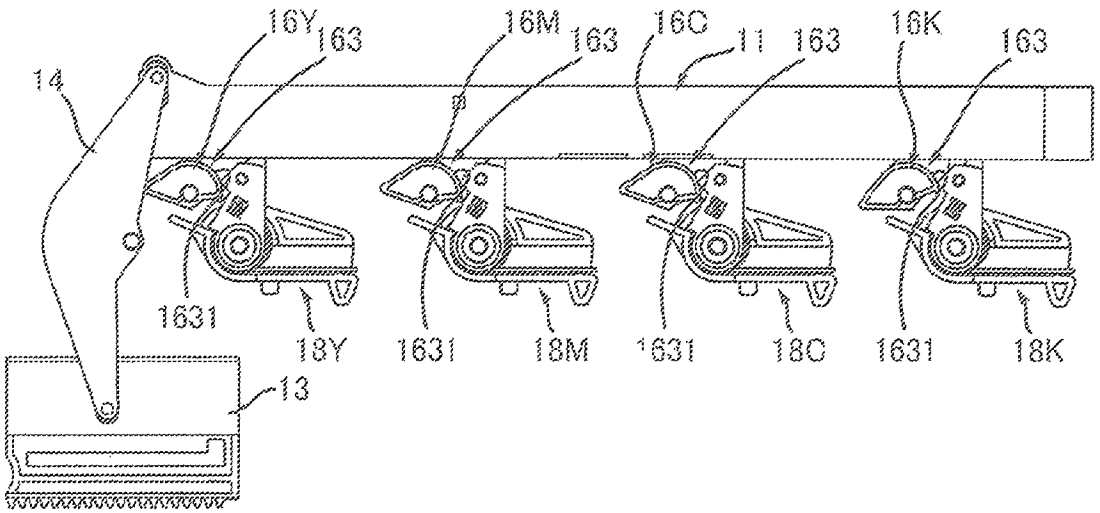
FIG. 17A is one side view of the first cam, the first spacing member, and the first lock member illustrated in FIG. 16A, illustrating a state in which the first cam is located at a cam third position.
Figure 17B:
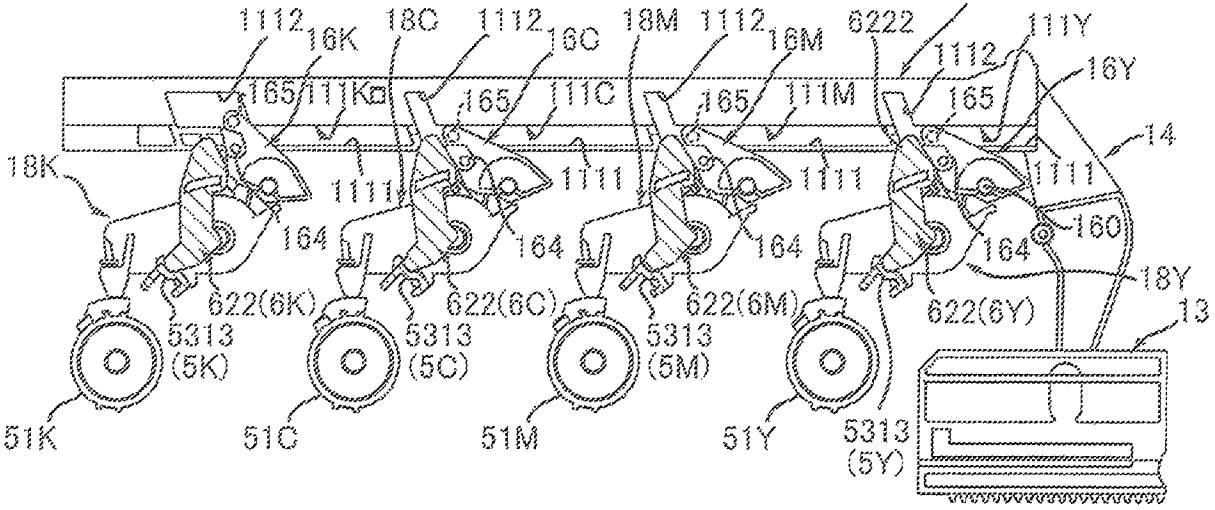
FIG. 17B is the other side view of the first cam, the first spacing member, and the first lock member illustrated in FIG. 16B, illustrating the state in which the first cam is located at the cam third position.

As illustrated in FIG. 16B and FIG. 17B, the first spacing member 16Y moves the developing cartridge 6Y between the contact position and the spaced position. The first spacing member 16Y is movable with respect to the housing 2. The first spacing member 16Y is rotatable about a first axis 160 between a first position (see FIG. 16B) and a second position (see FIG. 17B) in a state in which the cover 3 is located at the closed position (see FIG. 1). The first axis 160 extends in the first direction. The first spacing member 16Y causes the developing cartridge 6Y to be located at the contact position in a state in which the first spacing member 16Y is located at the first position (see FIG. 16B). The first spacing member 16Y causes the developing cartridge 6Y to be located at the spaced position in a state in which the first spacing member 16Y is located at the second position (see FIG. 17B).

The first spacing member 16Y is located at a third position (see FIG. 15A) in a state in which the cover 3 is located at the open position (see FIG. 2). The first spacing member 16Y moves from the third position to the first position when the cover 3 moves from the open position to the closed position.

Figure 11A:
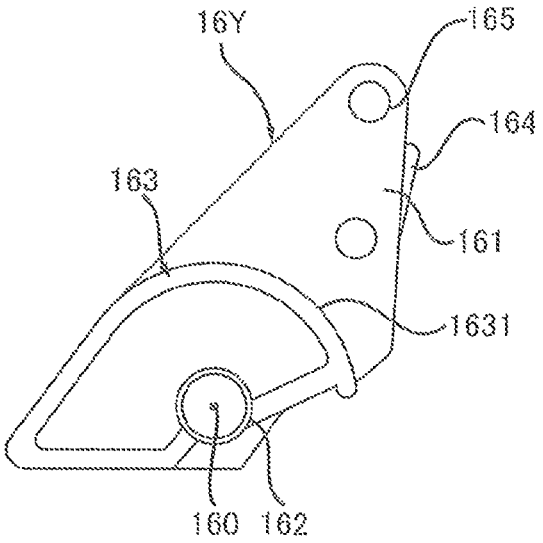
FIG. 11A is one side view of the first spacing member illustrated in FIG. 10.
Figure 11B:
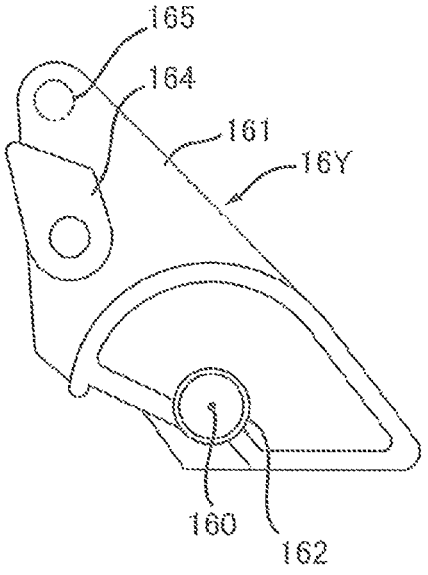
FIG. 11B is the other side view of the first spacing member illustrated in FIG. 10.

As illustrated in FIG. 11A and FIG. 11B, the first spacing member 16Y includes a first body 161, a shaft 162, a first lock contact portion 163 (see FIG. 11A), the first boss 164 (see FIG. 11B), and a second boss 165 (see FIG. 11A).

5.1.1.1 First Body 161

The first body 161 supports each of the shaft 162, the first lock contact portion 163 (as an example of a protrusion), the first boss 164, and the second boss 165. The first body 161 is located on the opposite side of the photoconductive drum 51Y with respect to the guide 22Y in the first direction (see FIG. 9A).

5.1.1.2 Shaft 162

The shaft 162 extends along the first axis 160. The shaft 162 is provided at an end portion of the first body 161. The shaft 162 is rotatably supported by the housing 2.

5.1.1.3 First Lock Contact Portion 163

As illustrated in FIG. 11A, the first lock contact portion 163 extends from the first body 161 in the first direction. The first lock contact portion 163 has a first contact surface 1631 (as an example of a spacing cam surface). The first contact surface 1631 is spaced apart from the shaft 162 in the radial direction of the shaft 162. The first contact surface 1631 is a part of a peripheral surface of a cylindrical shape, and an axis of the peripheral surface is the first axis 160.

5.1.1.4 First Boss 164

As illustrated in FIG. 11B, the first boss 164 is located on the opposite side of the first lock contact portion 163 with respect to the first body 161 in the first direction. The first boss 164 is spaced apart from the shaft 162 in the radial direction of the shaft 162. The first boss 164 extends from the first body 161 in the first direction.

As illustrated in FIG. 16B, the first boss 164 of the first spacing member 16Y is spaced apart from the second end portion 6222 of the arm 622 when the first spacing member 16Y is located at the first position in the state in which the developing cartridge 6Y is mounted on the drum cartridge 5Y and the drum cartridge 5Y is mounted on the housing 2. Accordingly, the developing cartridge 6Y is pressed by the two pressing members 55Y, 56Y and located at the contact position (see FIG. 3A) in the state in which the first spacing member 16Y is located at the first position.

As illustrated in FIG. 17B, the first boss 164 of the first spacing member 16Y is in contact with the second end portion 6222 of the arm 622 when the first spacing member 16Y is located at the second position in the state in which the developing cartridge 6Y is mounted on the drum cartridge 5Y and the drum cartridge 5Y is mounted on the housing 2. When the first spacing member 16Y moves from the first position to the second position, the first boss 164 presses the second end portion 6222 of the arm 622. Then, the drum cartridge 5Y moves from the contact position to the spaced position against the two pressing members 55Y, 56Y so as to be set a contact portion between the first end portion 6221 and the first contact portion 5313 to a fulcrum as illustrated in FIG. 5. Accordingly, the developing cartridge 6Y is located at the spaced position (see FIG. 3B) in the state in which the first spacing member 16Y is located at the second position.

Figure 9B:
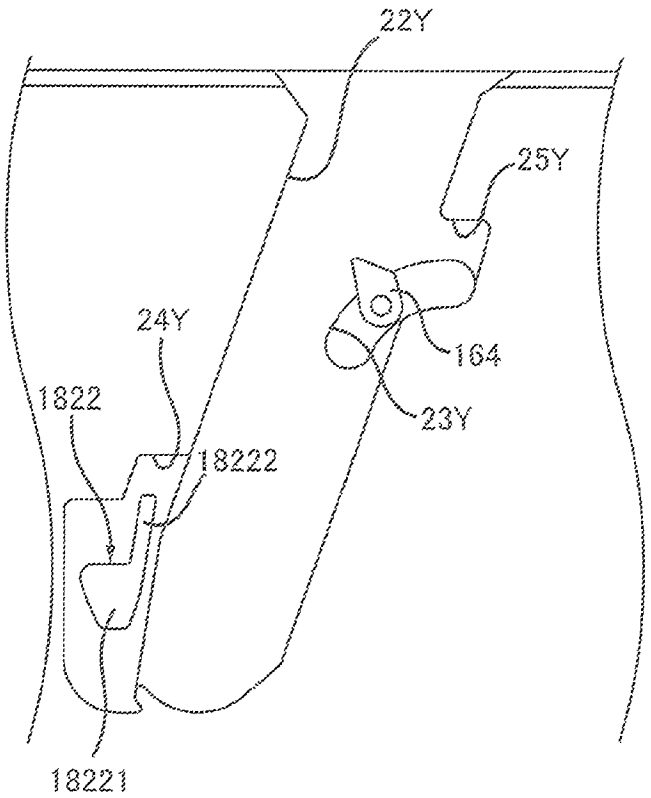
FIG. 9B is an enlarged view of the guide, the first boss, and the first protrusion illustrated in FIG. 8, illustrating a state in which the first spacing member is located at a first position and the first lock member is located at a lock position.

The first boss 164 is located inside the guide 22Y in a state in which the first spacing member 16Y is located at the first position or the second position as illustrated in FIG. 9B.

Figure 9A:
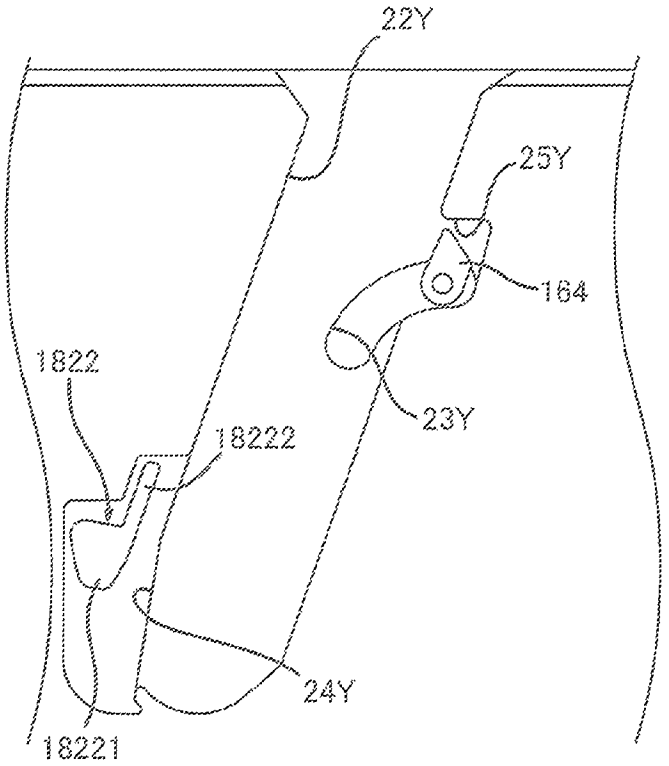
FIG. 9A is an enlarged view of the guide, a first boss, and a first protrusion illustrated in FIG. 8, illustrating the state in which the first spacing member is located at the third position and the first lock member is located at the lock releasing position.

The first boss 164 is located inside the groove 25Y and constituting a part of the guide 22Y in a state in which the first spacing member 16Y is located at the third position as illustrated in FIG. 9A.

5.1.1.5 Second Boss 165

As illustrated in FIG. 11A, the second boss 165 is located on the opposite side of the first boss 164 with respect to the first body 161 in the first direction. The second boss 165 is located on the opposite side of the shaft 162 with respect to the first contact surface 1631. The second boss 165 extends from the first body 161 in the first direction. The second boss 165 comes into contact with the first cam 11. In other words, the first spacing member 16Y comes into contact with the first cam 11.

The second boss 165 is fitted into a second portion 1112 of a first groove 111Y (see FIG. 15B and FIG. 16B) in a state in which the first spacing member 16Y is located at the first position or the third position. The first groove 111Y will be explained later. The second boss 165 is in contact with an inner surface of the second portion 1112 in the state in which the second boss 165 is fitted into the second portion 1112.

The second boss 165 is fitted into a first portion 1111 of the first groove 111Y (see FIG. 18) in the state in which the first spacing member 16Y is located at the second position. The second boss 165 is in contact with an upper surface of the first portion 1111 in a state in which the second boss 165 is fitted into the first portion 1111.

5.2 Four Second Spacing Members 17Y, 17M, 17C, 17K

As illustrated in FIG. 10, the four second spacing members 17Y, 17M, 17C, and 17K are supported by the housing 2. The four second spacing members 17Y, 17M, 17C, and 17K are located so as to be spaced apart from one another in the second direction. The four second spacing members 17Y, 17M, 17C, and 17K have the same structure as one another. Therefore, the second spacing member 17Y will be explained in detail, and explanation for the second spacing members 17M, 17C, and 17K is omitted.

5.2.1 Second Spacing Member 17Y

The second spacing member 17Y moves the developing cartridge 6Y between the contact position and the spaced position together with the first spacing member 16Y. The second spacing member 17Y is located on the opposite side of the first spacing member 16Y with respect to the developing cartridge 6Y in the first direction in the state in which the developing cartridge 6Y is mounted on the drum cartridge 5Y and the drum cartridge 5Y is mounted on the housing 2.

The second spacing member 17Y is rotatable about an axis between a fourth position and a fifth position in the state in which the cover 3 is located at the closed position (see FIG. 1). The axis of the second spacing member 17Y extends in the first direction. The second spacing member 17Y causes the developing cartridge 6Y to be located at the contact position in a state in which the second spacing member 17Y is located at the fourth position (see FIG. 12A). The second spacing member 17Y causes the developing cartridge 6Y to be located at the spaced position in a state in which the second spacing member 17Y is located at the fifth position (see FIG. 12B).

The second spacing member 17Y is located at a sixth position in the state in which the cover 3 is located at the open position (see FIG. 2) though not illustrated. The second spacing member 17Y moves from the sixth position to the fourth position when the cover 3 moves from the open position to the closed position.

As illustrated in FIG. 12A to FIG. 12D, the second spacing member 17Y includes a second body 171, a shaft 174, a second lock contact portion 172, and a boss 173.

5.2.1.1 Second Body 171

The second body 171 supports each of the shaft 174, the second lock contact portion 172, and the boss 173. The second body 171 has a first end portion 1711 and a second end portion 1712 located apart from the first end portion 1711.

Figures 12A, 12B, 12C, 12D:
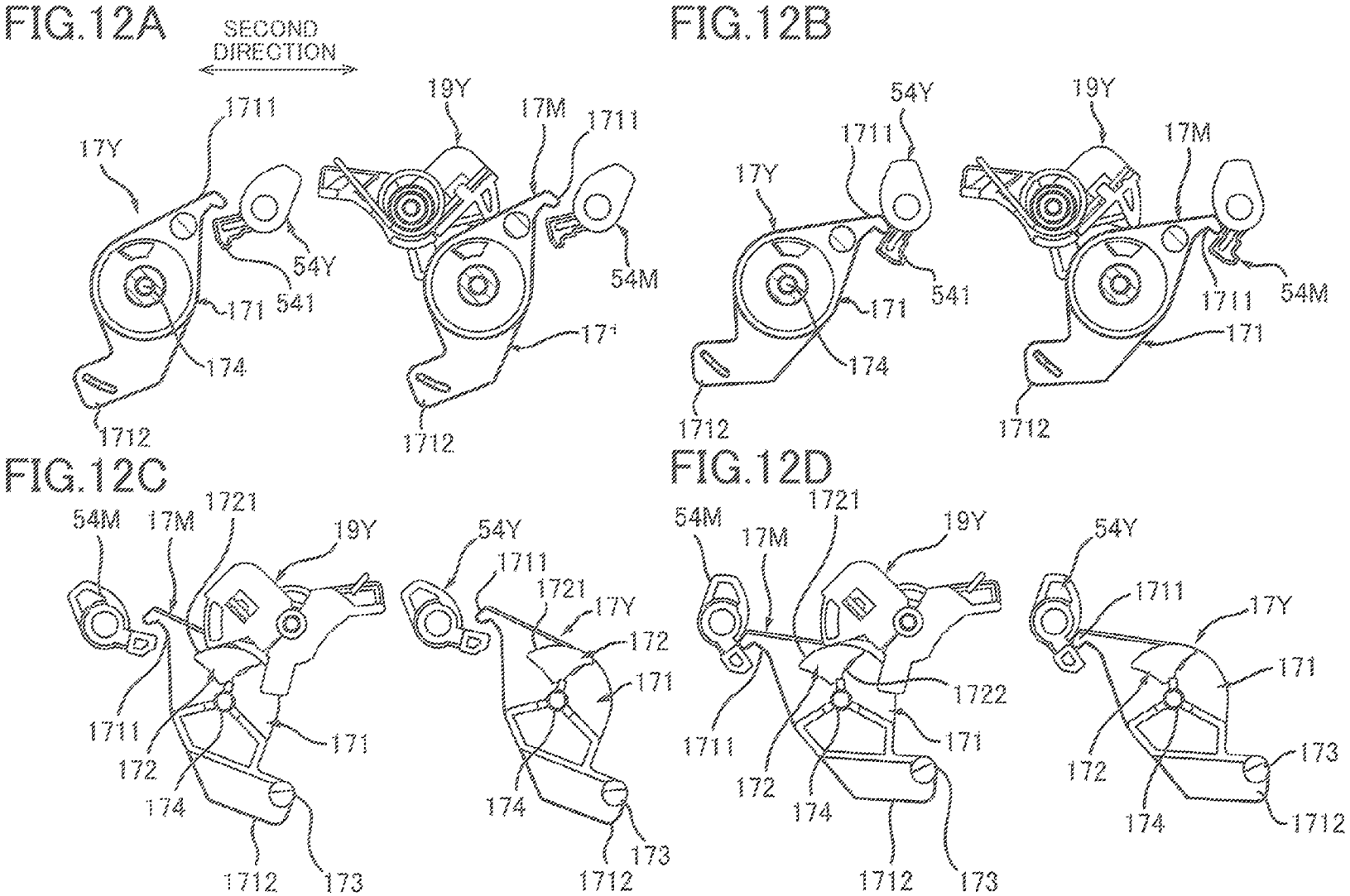
FIG. 12A is one side view of the second spacing member illustrated in FIG. 10, illustrating a state in which the second spacing member is located at a fourth position.
FIG. 12B is one side view of the second spacing member illustrated in FIG. 10, illustrating a state in which the second spacing member is located at a fifth position.
FIG. 12C is the other side view of the second spacing member illustrated in FIG. 10, illustrating the state in which the second spacing member is located at the fourth position.
FIG. 12D is other side view of the second spacing member illustrated in FIG. 10, illustrating the state in which the second spacing member is located at the fifth position.

As illustrated in FIG. 12A, the first end portion 1711 of the second spacing member 17Y is spaced apart from the first portion 541 of the pivoting member 54Y of the drum cartridge 5Y when the second spacing member 17Y is located at the fourth position in the state in which the developing cartridge 6Y is mounted on the drum cartridge 5Y and the drum cartridge 5Y is mounted on the housing 2. The second spacing member 17Y causes the developing cartridge 6Y to be located at the contact position (see FIG. 3A) together with the first spacing member 16Y in a state in which the first spacing member 16Y is located at the first position and the second spacing member 17Y is located at the fourth position.

As illustrated in FIG. 12B, the first end portion 1711 of the second spacing member 17Y is in contact with the first portion 541 of the pivoting member 54Y when the second spacing member 17Y is located at the fifth position in the state in which the developing cartridge 6Y is mounted on the drum cartridge 5Y and the drum cartridge 5Y is mounted on the housing 2. The first end portion 1711 presses the first portion 541 of the pivoting member 54Y when the second spacing member 17Y moves from the fourth position to the fifth position. Then, the pivoting member 54Y pivots and the second portion 542 of the pivoting member 54Y presses the protrusion 6241 of the second support portion 624 so as to be spaced apart from the photoconductive drum 51Y as illustrated in FIG. 7. Accordingly, the second spacing member 17Y causes the developing cartridge 6Y to be located at the spaced position (see FIG. 3B) together with the first spacing member 16Y in a state in which the first spacing member 16Y is located at the second position and the second spacing member 17Y is located at the fifth position.

5.2.1.2 Shaft 174

The shaft 174 extends along the axis of the second spacing member 17Y. The shaft 174 is provided at the center of the second body 171. The shaft 174 is rotatably supported by the housing 2.

5.2.1.3 Second Lock Contact Portion 172

As illustrated in FIG. 12C, the second lock contact portion 172 is located between the shaft 174 and the first end portion 1711. The second lock contact portion 172 extends from the second body 171 in the first direction. The second lock contact portion 172 includes a second contact surface 1721. The second contact surface 1721 is a part of a peripheral surface of a cylindrical shape, and an axis of the peripheral surface is the axis of the second spacing member 17Y. It is not always necessary that the second spacing member 17Y has the second lock contact portion 172.

5.2.1.4 Boss 173

The boss 173 is provided at the second end portion 1712 of the second body 171. The boss 173 extends from the second body 171 in the first direction. The boss 173 comes into contact with the second cam 12. In other words, the second spacing member 17Y comes into contact with the second cam 12.

Figure 14A:
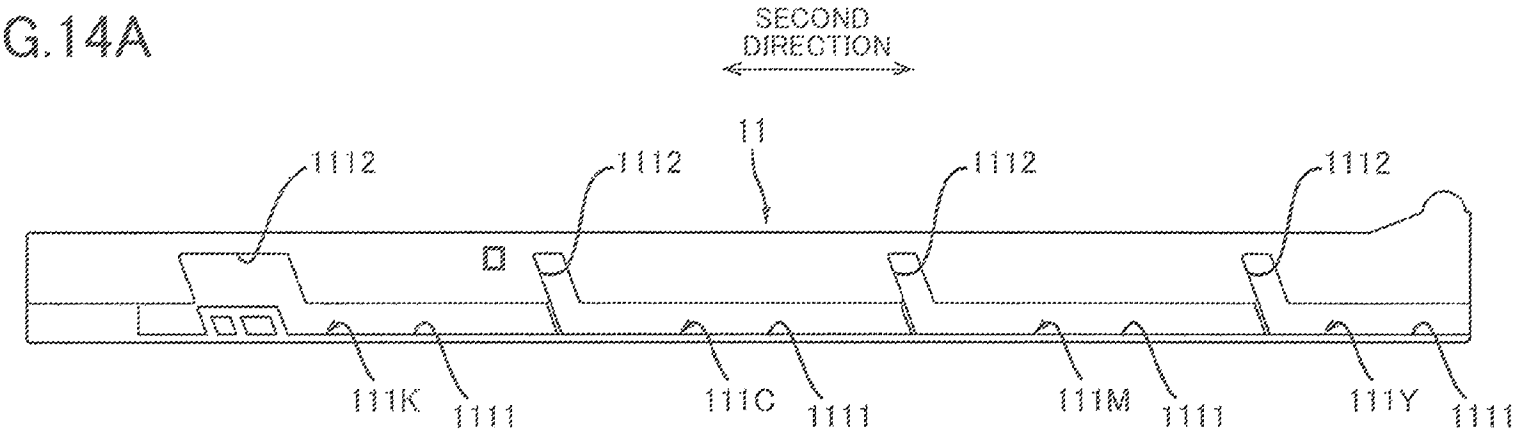
FIG. 14A is a side view of a first cam illustrated in FIG. 10.
Figure 14B:
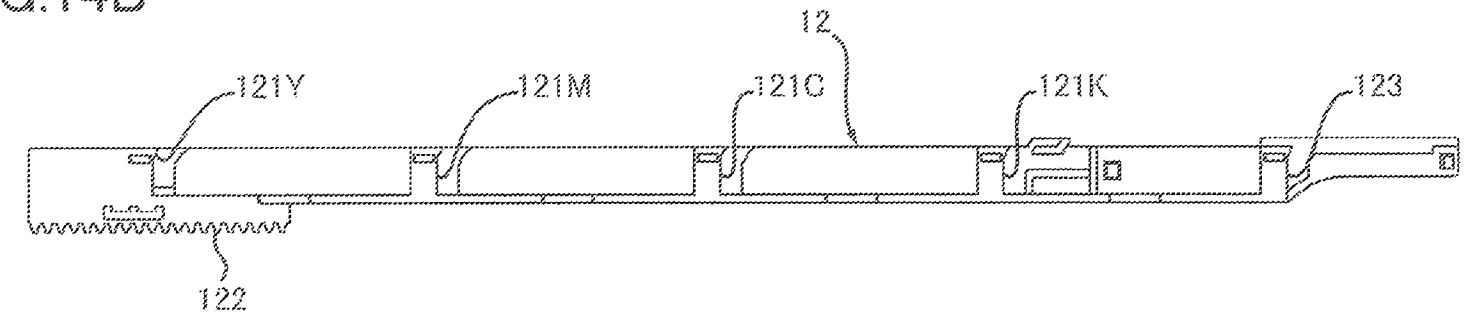
FIG. 14B is a side view of a second cam illustrated in FIG. 10.

The boss 173 is fitted into a second groove 121Y in a state in which the second spacing member 17Y is located at the fourth position or the sixth position (see FIG. 14B). The second groove 121Y will be explained later. The boss 173 is in contact with an inner surface of the second groove 121Y in a state in which the boss 173 is fitted into the second groove 121Y. The boss 173 is in contact with an upper surface of the second cam 12 in the state in which the second spacing member 17Y is located at the fifth position.

5.3 Four First Lock Members 18Y, 18M, 18C, 18K

As illustrated in FIG. 10, the four first lock members 18Y, 18M, 18C, and 18K are supported by the housing 2. The four first lock members 18Y, 18M, 18C, and 18K are located so as to be spaced apart from one another in the second direction. The four first lock members 18Y, 18M, 18C, and 18K are located between the first cam 11 and the second cam 12 in the vertical direction. The first cam 11 and the second cam 12 will be explained later. The four first lock members 18Y, 18M, 18C, and 18K have the same structure as one another. Therefore, the first lock member 18Y will be explained in detail, and explanation for the first lock members 18M, 18C, and 18K is omitted.

5.3.1 First Lock Member 18Y

The first lock member 18Y and the first spacing member 16Y are arranged in the second direction. The first lock member 18Y is movable between the lock position (see FIG. 16B) and a lock releasing position (see FIG. 15B). The first lock member 18Y locks the photoconductive drum 51Y to the housing 2 in a state in which the first lock member 18Y is located at the lock position. The lock of the photoconductive drum 51Y with respect to the housing 2 is released in a state in which the first lock member 18Y is located at the lock releasing position.

Figure 13A:
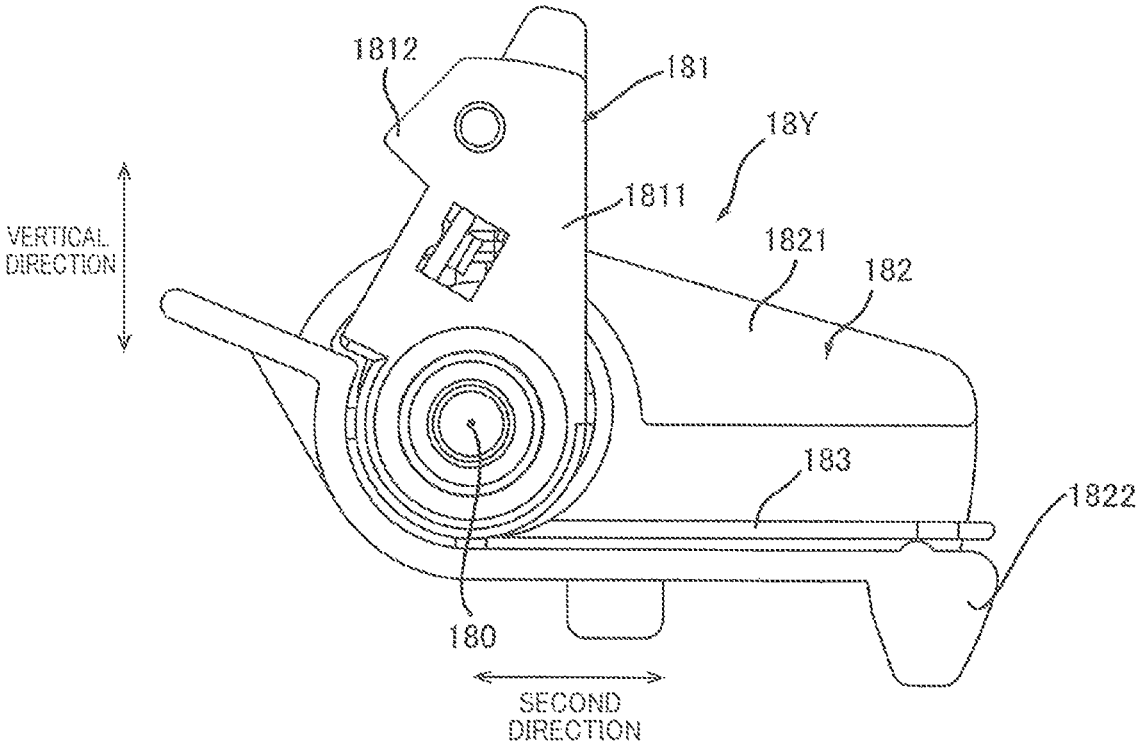
FIG. 13A is one side view of the first lock member illustrated in FIG. 10.
Figure 13B:
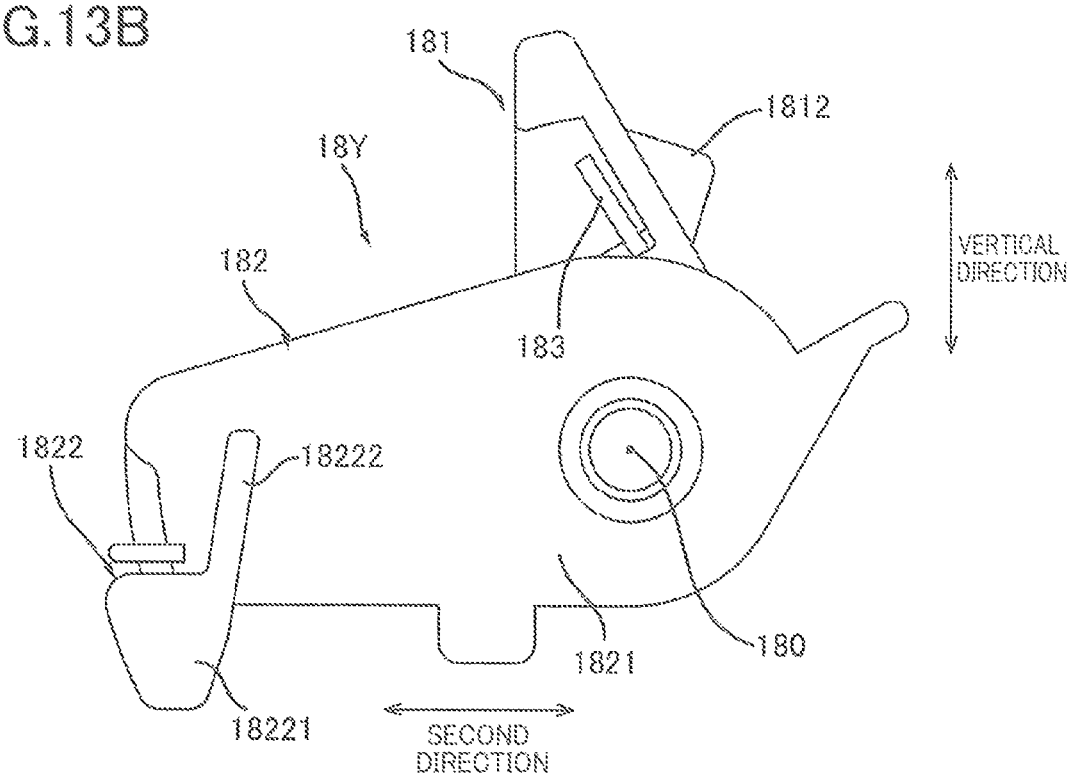
FIG. 13B is the other side view of the first lock member illustrated in FIG. 10.
Figure 15A:
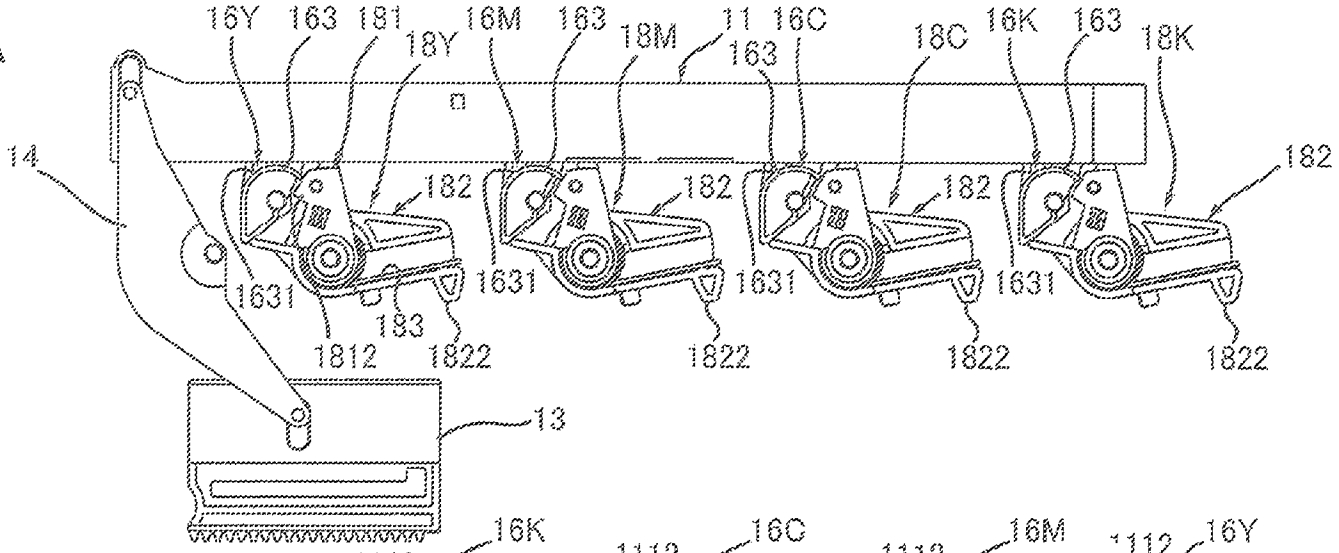
FIG. 15A is one side view of the first cam, the first spacing member, and the first lock member illustrated in FIG. 10, illustrating a state in which the first cam is located at a cam first position.
Figure 15B:
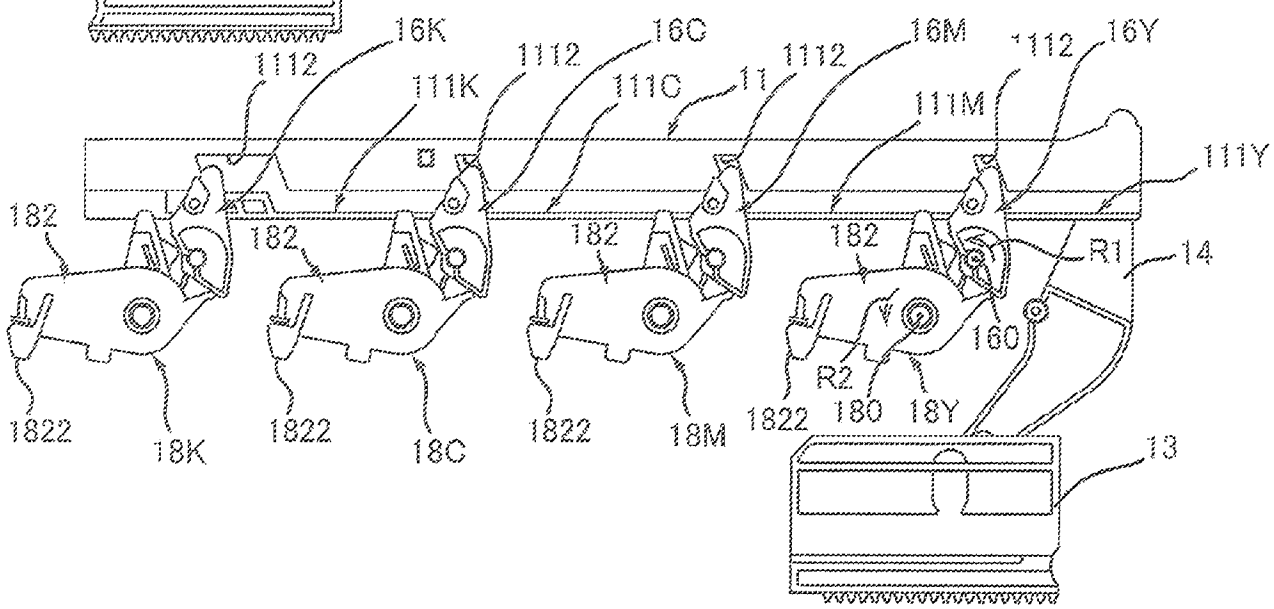
FIG. 15B is the other side view of the first cam, the first spacing member, and the first lock member illustrated in FIG. 10, illustrating the state in which first cam is located at the cam first position.

As illustrated in FIG. 15B, the first lock member 18Y is rotatable about a second axis 180 between the lock position and the lock releasing position. A rotation direction R1 in which the first spacing member 16Y moves from the first position to the second position is the same as a rotation direction R2 in which the first lock member 18Y moves from the lock releasing position to the lock position. The second axis 180 extends in the first direction. The second axis 180 of the first lock member 18Y is spaced apart from the first axis 160 of the first spacing member 16Y. The second axis 180 of the first lock member 18Y is located below the first axis 160 of the first spacing member 16Y As illustrated in FIG. 13A and FIG. 13B, the first lock member 18Y includes a lock arm 182, a lock lever 181, and a spring 183.

5.3.1.1 Lock Arm 182

The lock arm 182 is supported by the housing 2. The lock arm 182 includes a body 1821 and the first protrusion 1822. In other words, the first lock member 18Y includes the body 1821 and the first protrusion 1822.

5.3.1.2 Body 1821

The body 1821 extends in the second direction in a state in which the first lock member 18Y is located at the lock position. The body 1821 is rotatable about the second axis 180. The body 1821 supports the first protrusion 1822. The body 1821 is located on the opposite side of the photoconductive drum 51Y with respect to the guide 22Y in the first direction in the state in which the drum cartridge 5Y is mounted on the housing 2 (see FIG. 9A). Accordingly, it is possible to suppress that the body 1821 of the first lock member 18Y becomes an obstacle for mounting/detaching the drum cartridge 5Y on/from the housing 2.

5.3.1.3 First Protrusion 1822

The first protrusion 1822 extends in the first direction. The first protrusion 1822 of the first lock member 18Y passes through the second hole 24Y (see FIG. 9A). The first protrusion 1822 is spaced apart from the second axis 180 in the second direction. The first protrusion 1822 has a protrusion body 18221 and a guide rib 18222.

The protrusion body 18221 protrudes downward from the body 1821 in the state in which the first lock member 18Y is located at the lock position. The guide rib 18222 extends upward from the protrusion body 18221 in the state in which first lock member 18Y is located at the lock position.

As illustrated in FIG. 16B, the protrusion body 18221 of the first protrusion 1822 is in contact with the second protrusion 5312 of the drum cartridge 5Y in a state in which the drum cartridge 5Y is mounted on the housing 2 and the first lock member 18Y is located at the lock position. Accordingly, the photoconductive drum 51Y can be stably locked to the housing 2 in the state in which the first lock member 18Y is located at the lock position.

The protrusion body 18221 of the first protrusion 1822 is spaced apart from the second protrusion 5312 of the drum cartridge 5Y in a state in which the drum cartridge 5Y is mounted on the housing 2 and the first lock member 18Y is located at the lock releasing position.

As illustrated in FIG. 9A, the first protrusion 1822 of the lock member 18Y is constituting a part of the guide 22Y in the state in which the first lock member 18Y is located at the lock releasing position. The guide rib 18222 of the first protrusion 1822 is formed along a direction in which the guide 22Y extends in the state in which the first lock member 18Y is located at the lock releasing position. Accordingly, the first protrusion 1822 of the first lock member 18Y can guide mounting/detachment of the drum cartridge 5Y on/from the housing 2 in the state in which the first lock member 18Y is located at the lock releasing position.

As illustrated in FIG. 9A and FIG. 9B, the first protrusion 1822 moves in the vertical direction when the first lock member 18Y moves between the lock position and the lock releasing position. Accordingly, the first protrusion 1822 is allowed to contact the drum cartridge 5Y in the state in which the first lock member 18Y is located at the lock position, while suppressing that the first protrusion 1822 enters the guide 22Y and becomes an obstacle for mounting/detaching the drum cartridge 5Y on/from the housing 2 in the state in which the first lock member 18Y is located at the lock releasing position.

5.3.2 Lock Lever 181

As illustrated in FIG. 13A, the lock lever 181 is supported by the body 1821 of the lock arm 182. The lock lever 181 is rotatable about the second axis 180. The lock lever 181 includes a lever body 1811 and a protrusion 1812.

The lever body 1811 extends in the vertical direction. The protrusion 1812 is spaced apart from the second axis 180. The protrusion 1812 is located on the opposite side of the first protrusion 1822 with respect to the lever body 1811 in the second direction. The protrusion 1812 protrudes from the lever body 1811 in the second direction.

5.3.3 Spring 183

The spring 183 is specifically a torsion spring. One end of the spring 183 is supported by the lever body 1811. The other end of the spring 183 is supported by the lock arm 182.

5.3.4 Movement from Lock Releasing Position to Lock Position in First Lock Member 18Y As illustrated in FIG. 15A, the protrusion 1812 of the first lock member 18Y is spaced apart from the first contact surface 1631 of the first spacing member 16Y in the state in which the first spacing member 16Y is located at the third position. The spring 183 holds the lock arm 182 in this state so that the first protrusion 1822 of the lock arm 182 is spaced apart from the drum cartridge 5Y. Accordingly, the first lock member 18Y is located at the lock releasing position in a state in which the protrusion 1812 is spaced apart from the first contact surface 1631.

As illustrated in FIG. 15A and FIG. 16A, the first lock member 18Y is pushed by the first spacing member 16Y when the first spacing member 16Y moves from the third position to the first position, thereby moving from the lock releasing position to the lock position. Specifically, the protrusion 1812 of the first lock member 18Y comes into contact with the first lock contact portion 163 of the first spacing member 16Y when the first spacing member 16Y moves from the third position to the first position, and the lock lever 181 is pushed by the first lock contact portion 163. That is, a surface of the protrusion 1812 comes into contact with the first contact surface 1631 of the first lock contact portion 163. In other words, the lock member 18Y includes the surface of the protrusion 1812 with which the first contact surface 1631 comes into contact. The surface of the protrusion 1812 is an example of a lock surface. Then, the spring 183 pushes the lock arm 182 so that the first protrusion 1822 of the lock arm 182 comes into contact with the drum cartridge 5Y in a state in which the protrusion 1812 of the first lock member 18Y is in contact with the first contact surface 1631 of the first spacing member 16Y Accordingly, the first lock member 18Y is located at the lock position in the state in which the protrusion 1812 is in contact with the first contact surface 1631.

Accordingly, since the first lock member 18Y moves by being pushed by the first spacing member 16Y acting on the same drum cartridge 5Y when the first spacing member 16Y moves, the first spacing member 16Y and the first lock member 18Y acting on the same drum cartridge 5Y can be directly interlocked. Accordingly, the first spacing member 16Y and the first lock member 18Y can be moved at proper timing.

Moreover, the first spacing member 16Y can move from the first position to the second position in the state in which the first lock member 18Y is located at the lock position as illustrated in FIG. 16B and the FIG. 17B. Accordingly, the first spacing member 16Y moves the developing cartridge 6Y from the contact position to the spaced position in the state in which the first lock member 18Y is located at the lock position. Therefore, the developing cartridge 6Y can be stably moved from the contact position to the spaced position in a state in which the photoconductive drum 51Y is locked to the housing 2.

5.4 Four Second Lock Members 19Y, 19M, 19C, 19K

As illustrated in FIG. 10, the four second lock members 19Y, 19M, 19C, and 19K are supported by the housing 2. The four second lock members 19Y, 19M, 19C, and 19K are located so as to be spaced apart from one another in the second direction. The three second lock members 19Y, 19M, and 19C have the same structure as one another. Therefore, the second lock members 19Y and 19K will be explained in detail, and explanation for the second lock members 19M, 19C is omitted.

5.4.1 Second Lock Member 19Y

The second lock member 19Y is located on the opposite side of the first lock member 18Y with respect to the developing cartridge 6Y in the first direction in the state in which the developing cartridge 6Y is mounted to the drum cartridge 5Y and the drum cartridge 5Y is mounted on the housing 2.

As illustrated in FIG. 12C, the second lock member 19Y is located between the second spacing member 17Y and the second spacing member 17M in the second direction. The second lock member 19Y is movable between the lock position (see FIG. 12C) and the lock releasing position (not illustrated). The second lock member 19Y locks the photoconductive drum 51Y to the housing 2 together with the first lock member 18Y in a state in which each of the first lock member 18Y and the second lock member 19Y is located at the lock position. The lock of the photoconductive drum 51Y with respect to the housing 2 is released in a state in which each of the first lock member 18Y and the second lock member 19Y is located at the lock releasing position.

The second lock member 19Y is located at the lock releasing position in a state in which the second spacing member 17M is located at the sixth position. The second lock member 19Y is pushed by the second spacing member 17M to thereby move from the lock releasing position to the lock position. Specifically, the second lock contact portion 172 of the second spacing member 17M comes into contact with the second lock member 19Y when the second spacing member 17M moves from the sixth position to the fourth position to thereby move the second lock member 19Y from the lock releasing position to the lock position.

The second lock member 19Y is in contact with the second contact surface 1721 of the second spacing member 17M in the state in which the second lock member 19Y is located at the lock position. The second spacing member 17M is movable between the fourth position and the fifth position in the state in which the second lock member 19Y is located at the lock position.

5.4.2 Second Lock Member 19K

As illustrated in FIG. 10, the second lock member 19K is movable between the lock position and the lock releasing position in the same manner as the second lock member 19Y. The second lock member 19K is pushed by a link member 191 to thereby move from the lock releasing position to the lock position. The link member 191 is positioned on the opposite side of the second spacing member 17C with respect to the second spacing member 17K in the second direction. The link member 191 has the same structure as that of the second spacing member 17Y except that the link member 191 does not have the first end portion 1711. Therefore, explanation for the link member 191 is omitted.

5.5 First Cam 11

The first cam 11 moves the four first spacing members 16Y, 16M, 16C, and 16K by contacting the four first spacing members 16Y, 16M, 16C, and 16K to (see FIG. 15A to FIG. 18). The first cam 11 extends in the second direction. The first cam 11 is located at an upper position than the second cam 12. In other words, the first cam 11 and the second cam 12 are disposed at positions different from each other in the vertical direction. Accordingly, the degree of freedom in disposition of the first cam 11 and the second cam 12 can be improved as compared with a case where the first cam 11 and the second cam 11 are disposed at the same position as each other in the vertical direction. As a result, the first cam 11 and the second cam 12 can be disposed even when the image forming apparatus 1 is reduced in size.

The first cam 11 is movable among a cam first position (see FIG. 15A), a cam second position (see FIG. 16A), a cam third position (see FIG. 17A), and a cam fourth position (see FIG. 18) in the second direction.

As illustrated in FIG. 15A, the first cam 11 is located at the cam first position in the state in which the cover 3 is located at the open position. The four first spacing members 16Y, 16M, 16C, and 16K are located at the third position in a state in which the first cam 11 is located at the cam first position. Accordingly, the four first lock members 18Y, 18M, 18C, and 18K are located at the lock releasing position in the state in which first cam 11 is located at the cam first position.

As illustrated in FIG. 15A and FIG. 16A, the first cam 11 moves from the cam first position to the cam second position when the cover 3 moves from the open position to the closed position. As illustrated in FIG. 16A and FIG. 16B, the four first spacing members 16Y, 16M, 16C, and 16K move from the third position to the first position and the four first lock members 18Y, 18M, 18C, and 18K move from the lock releasing position to the lock position when the first cam 11 moves from the cam first position to the cam second position. Accordingly, the four photoconductive drums 51Y, 51M, 51C, and 51C are locked to the housing 2 and the four developing cartridges 6Y, 6M, 6C, and 6K are positioned at the contact position in a state in which the first cam 11 is located at the cam second position.

Figure 18:
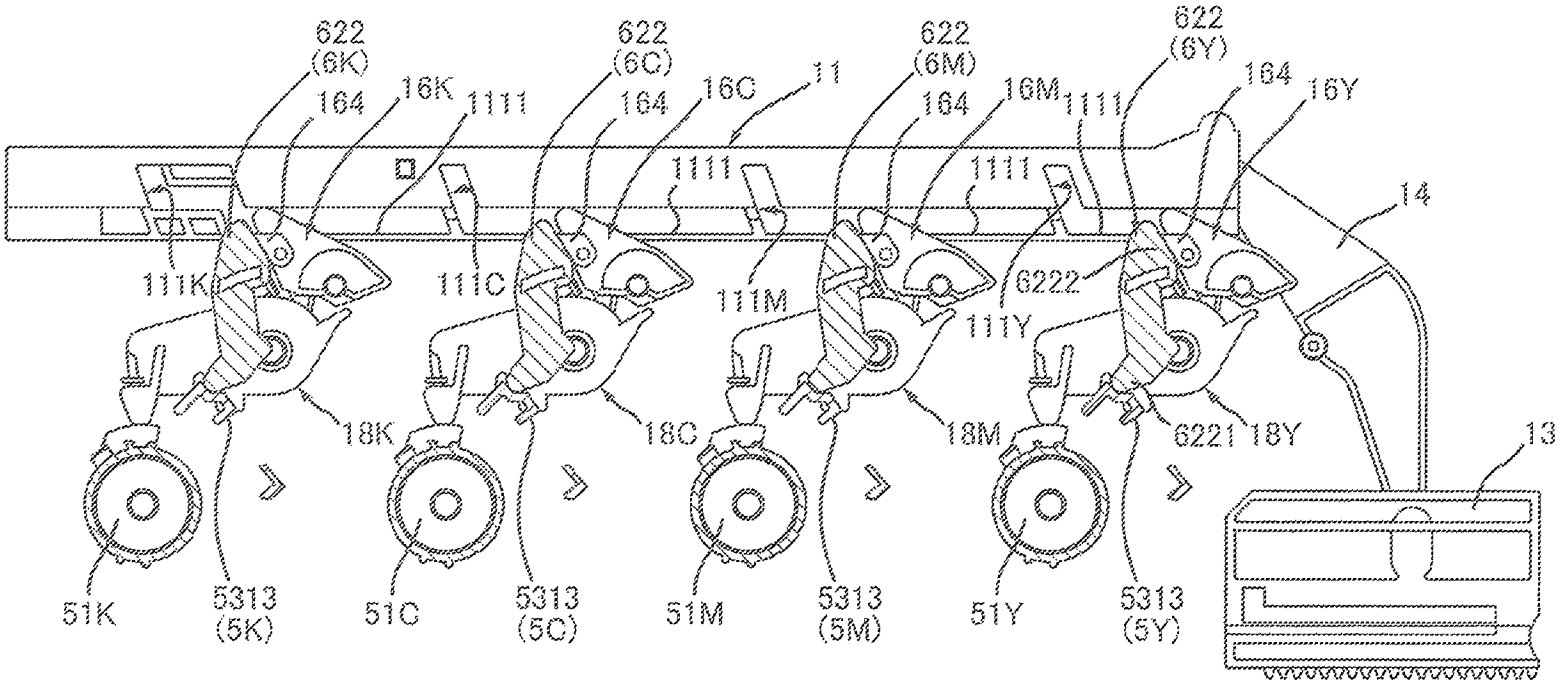
FIG. 18 is the other side view of the first cam, the first spacing member, and the first lock member illustrated in FIG. 17B, illustrating a state in which the first cam is located at a cam fourth position.

As illustrated in FIG. 16A to FIG. 18, the first cam 11 is movable among the cam second position, the cam third position, and the cam fourth position in the state in which the cover 3 is located at the closed position. As illustrated in FIG. 17A and FIG. 17B, when the first cam 11 moves from the cam second position to the cam third position, the three first spacing members 16Y, 16M, and 16C move from the first position to the second position and the first spacing member 16K is maintained at the first position. As illustrated in FIG. 18, when the first cam 11 moves from the cam third position to the cam fourth position, the three first spacing members 16Y, 16M, and 16C are maintained at the second position, and the first spacing member 16K moves from the first position to the second position. Note that the four first lock members 18Y, 18M, 18C, and 18K are maintained at the lock position when the first cam 11 moves among the cam second position, the cam third position, and the cam fourth position.

According to the above, when the first cam 11 moves from the cam second position to the cam third position, the three developing cartridges 6Y, 6M, and 6C move from the contact position to the spaced position and the developing cartridge 6K is maintained at the contact position in the state in which the four photoconductive drums 51Y, 51M, 51C, and 51K are locked to the housing 2. When the first cam 11 moves from the cam third position to the cam fourth position, the three developing cartridges 6Y, 6M, and 6C are maintained at the spaced position and the developing cartridge 6K moves form the contact position to the spaced position in the state in which the four photoconductive drums 51Y, 51M, 51C, and 51K are locked to the housing 2.

As illustrated in FIG. 14A, the first cam 11 includes four first grooves 111Y, 111M, 111C, and 111K.

5.5.1 Four First Grooves 111Y, 111M, 111C, 111K

The four first grooves 111Y, 111M, 111C, and 111K are located on a side surface of the first cam 11 in the first direction. The four first grooves 111*y*, 111M, 111C, and 111K are arranged in order in the second direction. The three first grooves 111Y, 111M, and 111C have the same structure as one another. Accordingly, the first grooves 111Y and 111K will be explained in detail, and explanation for the first grooves 111M and 111C is omitted.

The second boss 165 (see FIG. 11A) of the first spacing member 16Y is fitted into the first groove 111Y. The first groove 111Y is recessed in the first direction. The first groove 111Y includes the first portion 1111 and the second portion 1112. The first portion 1111 extends in the second direction. The first portion 1111 has one end and the other end spaced apart from one end in the second direction. The second portion 1112 is continued from the other end of the first portion 1111. The second portion 1112 extends in the vertical direction. The second portion 1112 goes away from one end of the first portion 1111 in the second direction as extending upward from the first portion 1111.

The second boss 165 of the first spacing member 16K is fitted into the first groove 111K. The first groove 111K has the first portion 1111 and the second portion 1112 in the same manner as the first groove 111Y A dimension of the second portion 1112 of the first groove 111K in the second direction is larger than a dimension of the second portion 1112 of the first groove 111Y in the second direction.

5.6 Second Cam 12

As illustrated in FIG. 10, the second cam 12 moves the four second spacing members 17Y, 17M, 17C, and 17K by contacting the four second spacing members 17Y, 17M, 17C, and 17K (see FIG. 12A to FIG. 12D). The second cam 12 is located on the opposite side of the first cam 11 with respect to the developing cartridge 6Y in the first direction in the state in which the developing cartridge 6Y is mounted on the drum cartridge 5Y and the drum cartridge 5Y is mounted on the housing 2. The second cam 12 is spaced apart from the first cam 11 in the first direction. The second cam 12 extends in the second direction. The second cam 12 is movable in the second direction. The first cam 11 and the second cam 12 respectively move in opposite directions in the second direction.

The second cam 12 causes each of the four second spacing members 17Y, 17M, 17C, and 17K to be located at the sixth position in the state in which the cover 3 is located at the open position. Accordingly, each of the four second lock members 19Y, 19M, 19C, and 19K is located at the lock releasing position.

The second cam 12 moves in the second direction when the cover 3 moves from the open position to the closed position to move each of the four second spacing members 17Y, 17M, 17C, and 17K from the sixth position to the fourth position. Accordingly, each of the four second lock members 19Y, 19M, 19C, and 19K moves from the lock releasing position to the lock position.

The second cam 12 is movable in the second direction in the state in which the cover 3 is located at the closed position, and moves each of the four second spacing members 17Y, 17M, 17C, and 17K between the fourth position and the fifth position.

As illustrated in FIG. 14B, the second cam 12 includes a rack gear 122. The second cam 12 includes four second grooves 121Y, 121M, 121C, 121K, and a third groove 123.

5.6.1. Rack Gear 122

The second cam 12 extends in the second direction. The second cam 12 includes one end and the other end spaced apart from one end in the second direction. The rack gear 122 is located on a lower surface in one end of the second cam 12. The rack gear 122 extends in the second direction. The rack gear 122 has a plurality of gear teeth.

5.6.2 Four Second Grooves 121Y, 121M, 121C, 121K

The four second grooves 121Y, 121M, 121C, and 121K are located on a side surface of the second cam 12 in the first direction. The four second grooves 121Y, 121M, 121C, and 121K are arranged in order in the second direction. The three second grooves 121Y, 121M, and 121C have the same structure as one another. Therefore, the second groove 121Y and the 121K will be explained in detail, and explanation for the second grooves 121M and 121C is omitted.

The boss 173 (see FIG. 12C) of the second spacing member 17Y is fitted into the second groove 121Y. The second groove 121Y is recessed in the first direction. The second groove 121Y extends downward from the upper surface of the second cam 12.

The boss 173 of the second spacing member 17K is fitted into the second groove 121K. The second groove 121K is recessed in the first direction. The second groove 121K extends downward from the upper surface of the second cam 12. A dimension of the second cam 121K in the second direction is larger than a dimension of the second groove 121Y in the second direction.

5.6.3 Third Groove 123

The third groove 123 is located on the side surface of the second cam 12 in the first direction. The third groove 123 is located on the opposite direction of the second groove 121C with respect to the second groove 121K in the second direction. A boss of the link member 191 is fitted into the third groove 123 (see FIG. 10). The third groove 123 is recessed in the first direction. The third groove 123 extends downward from the upper surface of the second cam 12.

5.7 Interlocking Member 13

As illustrated in FIG. 10, the interlocking member 13 is spaced apart from the second cam 12 in the first direction. The interlocking member 13 is located below the first cam 11. The interlocking member 13 interlocks with the second cam 12. The interlocking member 13 has a second rack gear 131.

5.7.1 Second Rack Gear 131

The second rack gear 131 is located on a lower surface of the interlocking member 13. The second rack gear 131 extends in the second direction. The second rack gear 131 includes a plurality of gear teeth. The number of gear teeth of the second rack gear 131 is the same as the number of gear teeth of the rack gear 122. A module of the gear teeth of the second rack gear 131 is the same as a module of the gear teeth of the rack gear 122.

5.8 Rotating Rod 14

The rotating rod 14 connects the first cam 11 and the interlocking member 13. The rotating rod 14 is supported by the housing 2. The rotating rod 14 is rotatable about an axis. The axis of the rotating rod 14 extends in the first direction.

The rotating rod 14 is located on the opposite side of the second cam 12 with respect to the first cam 11 in the first direction. The rotating rod 14 includes one end E1 and the other end E2. One end E1 of the rotating rod 14 is located at an upper position than the other end E2 of the rotating rod 14. One end E1 of the rotating rod 14 is coupled to one end of the first cam 11 in the second direction. One end E1 of the rotating rod 14 is movable in the vertical direction with respect to the first cam 11. The other end E2 of the rotating rod 14 is coupled to the interlocking member 13. The other end E2 of the rotating rod 14 is movable in the vertical direction with respect to the interlocking member 13.

5.9 Drive Transmission Mechanism 15

The drive transmission mechanism 15 transmits a drive force from a motor to the second cam 12 and the interlocking member 13. The drive transmission mechanism 15 includes a first gear 151, a second gear 152, and a shaft 153.

5.9.1 First Gear 151

The drive force from the motor is inputted to the first gear 151. The motor is not illustrated. The first gear 151 transmits the drive force to the second cam 12. The first gear 151 is a pinion gear that is engaged with the rack gear 122. The first gear 151 includes a plurality of gear teeth.

5.9.2 Second Gear 152

The second gear 152 transmits the drive force to the interlocking member 13. The second gear 152 is a pinion gear that is engaged with the second rack gear 131. The second gear 152 includes a plurality of gear teeth. The number of gear teeth of the second gear 152 is the same as the number of gear teeth of the first gear 151. A module of the gear teeth of the second gear 152 is the same as a module of the gear teeth of the first gear 151.

5.9.3 Shaft 153

The shaft 153 connects the first gear 151 and the second gear 152. The shaft 153 extends in the first direction. The shaft 153 includes on end and the other end spaced apart from one end in the first direction. The first gear 151 is mounted to one end of the shaft 153. The second gear 152 is mounted to the other end of the shaft 153.

According to the above, the second gear 152 transmits the drive force to the interlocking member 13 when the first gear 151 transmits the drive force to the second cam 12. Therefore, the second cam 12 moves, and the interlocking member 13 moves. Then, the rotating rod 14 rotates with the movement of the interlocking member 13. After that, the first cam 11 moves with the rotation of the rotating rod 14. As a result, the first cam 11 and the second cam 12 move in synchronization with each other.

6. Operation and Effect

As illustrated in FIG. 15A and FIG. 16A, the first lock member 18Y is pushed by the first spacing member 16Y acting on the same drum cartridge 5Y to thereby move from the lock releasing position to the lock position in the image forming apparatus 1. Accordingly, the first spacing member 16Y and the first lock member 18Y acting on the same drum cartridge 5Y can be directly interlocked to be moved at proper timing.

Then, the first spacing member 16Y moves the developing cartridge 6Y from the contact position to the spaced position in the state in which the first lock member 18Y is located at the lock position as illustrated in FIG. 17A and FIG. 17B. Accordingly, the developing cartridge 6Y can be stably moved from the contact position to the spaced position in the state in which the photoconductive drum 51Y is locked to the housing 2.

There will be next described the image forming apparatus 1 as a second embodiment in the present disclosure. It is noted that the same reference numerals as used in the first embodiment are used to designate the corresponding elements of the second embodiment, and an explanation of which is dispensed with.

7. Details of Drum Cartridge 5K

There will be described next the details of the drum cartridge 5K with reference to FIG. 19 and FIG. 20.

The drum cartridge 5K includes the drum flame 53K, a spacing lever 54K and a pressing member 55K (see FIG. 20) in addition to the above photo conductive drum 51K (see FIG. 3A), the above charging device 52K (see FIG. 3A).

7.1 Drum Flame 53K

The drum flame 53K supports the photo conductive drum 51K and the charging device 52K (see FIG. 3A). As illustrated in FIG. 19, the developing cartridge 6K is mountable/detachable on/from the drum flame 53K. The drum flame 53Y includes a side wall A531.

7.1.1 Side Wall A531

The side wall A531 is located at one end of the drum flame 53K in the first direction. The side wall A531 includes the bearing 5311 and a protrusion A5312.

The bearing 5311 supports one end of the photo conductive drum 51K in the first direction. The one end of the photo conductive drum 51K in the first direction is fitted into the bearing 5311. The bearing 5311 has a cylindrical shape. The bearing 5311 extends in the first direction.

The protrusion A5312 is in contact with a lock arm A191 included in the lock member A19K in a state in which the lock member A19K is located at the lock position. The lock member A19K will be explained later. The protrusion A5312 continued from the bearing 5311. The protrusion A5312 protrudes from the bearing 5311 in the radial direction of the bearing 5311. The protrusion A5312 is located at an upper position than the bearing 5311 in a state in which the drum cartridge 5K is mounted on the housing 2. The upper position means an upper position in a gravity direction at the time of placing the image forming apparatus 1 in a normal use state.

7.2 Spacing Lever 54K

Figure 20:
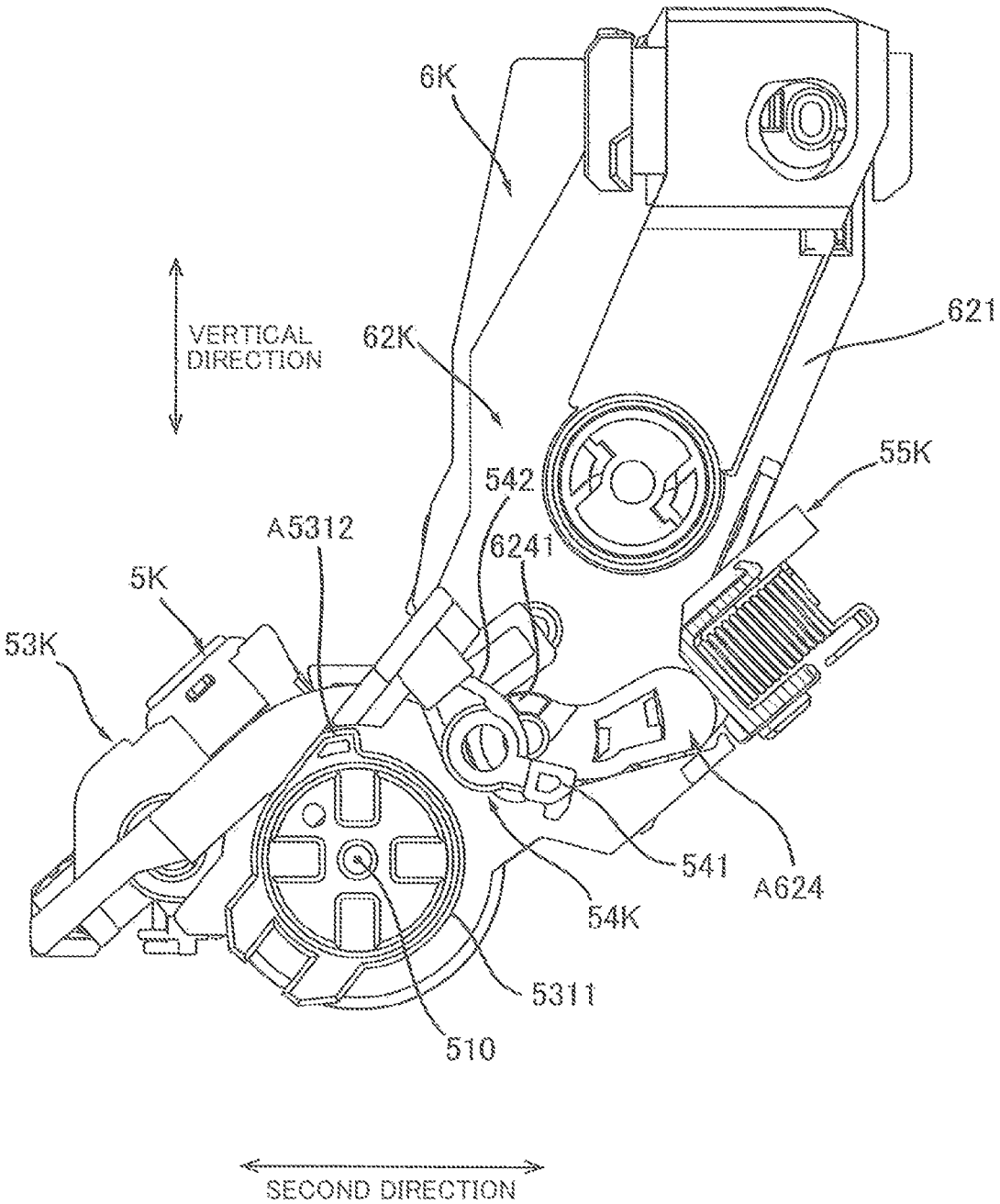
FIG. 20 is a view of the drum cartridge and the developing cartridge illustrated in FIG. 19, illustrating a state in which a side wall is removed.

As illustrated in FIG. 20, the spacing lever 54K is supported by the side wall A531. The spacing lever 54K is rotatable about an axis. The axis of the spacing lever 54K extends in the first direction. The spacing lever 54K includes the first portion 541 and the second portion 542. The first portion 541 is contactable with a first rotating member A16K in a state in which the drum cartridge 5K is mounted on the housing 2. It is noted that the first rotating member A16K is an example of a first spacing member. The first rotating member A16K will be explained later. The second portion 542 is located on the opposite side of the first portion 541 with respect to the axis of the spacing lever 54K. The second portion 542 is in contact with the protrusion 6241 included in the developing cartridge 6K in a state in which the first portion 541 is in contact with the first rotating member A16K. The protrusion 6241 will be explained later.

7.3 Pressing Member 55K

The pressing member 55K presses the developing roller 61K toward the contact position in a state in which the developing cartridge 6K is mounted on the drum cartridge 5K (see FIG. 20). The pressing member 55K is supported by the drum flame 53K. The pressing member 55K is located on the opposite side of the photo conductive drum 51K with respect to the spacing lever 54K.

8. Details of Developing Cartridge 6K

Figure 19:
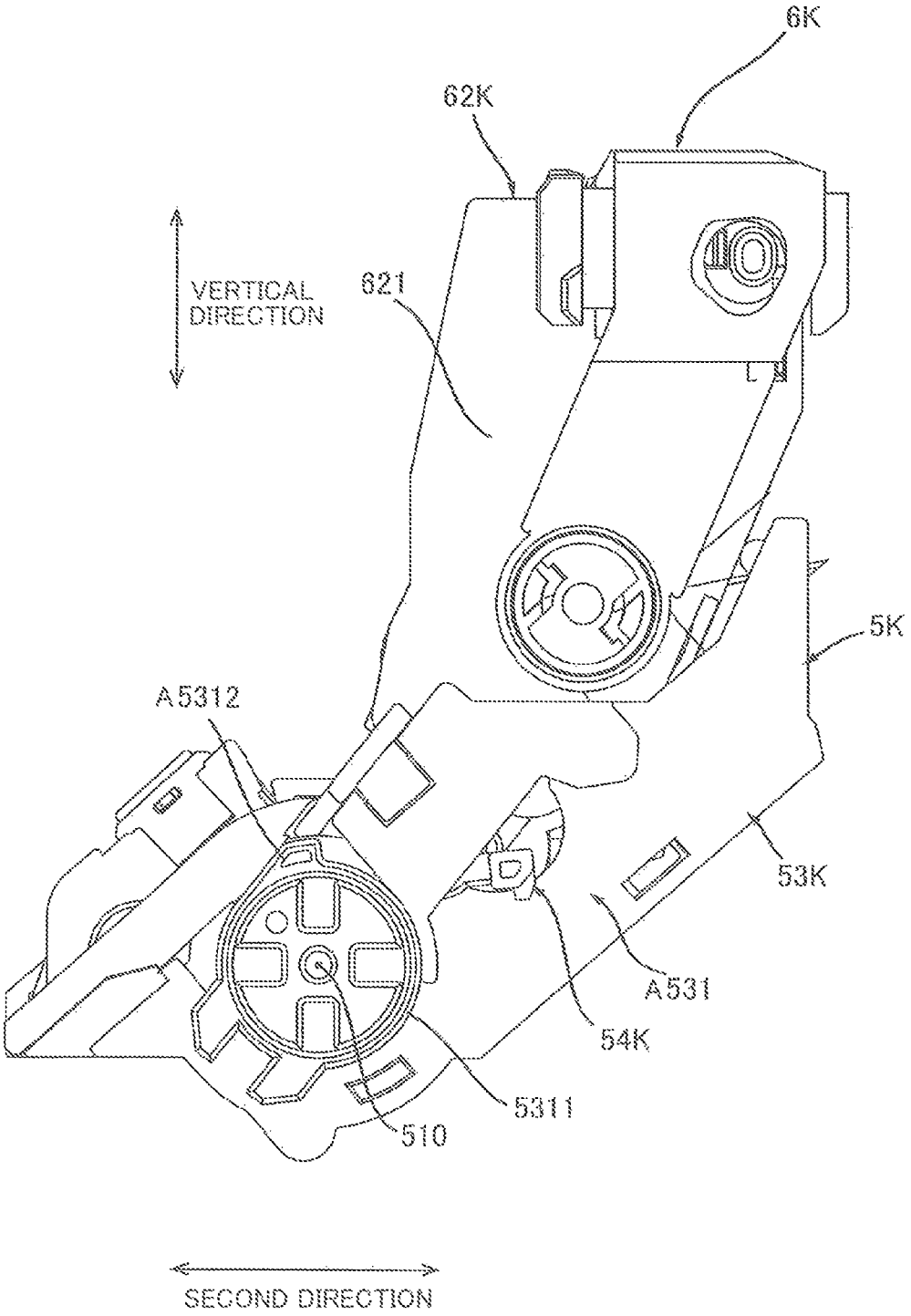
FIG. 19 is a side view of the drum cartridge and the developing cartridge illustrated in FIG. 3A.

There will be next described the details of the developing cartridge 6K with reference to FIG. 19 and FIG. 20.

The developing cartridge 6K includes a developing frame 62K in addition to the above developing roller 61K (see FIG. 3A).

8.1 Developing Frame 62K

As illustrated in FIG. 20, the developing frame 62K includes the developing housing 621 and a support portion A624. The developing housing 621 accommodates toner. The developing housing 621 extends in the first direction. The developing housing 621 and the side wall A531 are arranged in the first direction in the state in which the developing cartridge 6K is mounted on the drum cartridge 5K.

The support portion A624 supports one end of the developing roller 61K in the first direction (see FIG. 3A). The support portion A624 is located on the side surface of the developing housing 621 in the first direction. The support portion A624 is supported by the developing housing 621. The support portion A624 is located between the pressing member 55K and the photoconductive drum 51K in a state in which the developing cartridge 6K is mounted on the drum cartridge 5K. The support portion A624 is in contact with the pressing member 55K in the state in which the developing cartridge 6K is mounted on the drum cartridge 5K.

The support portion A624 includes the protrusion 6241. The protrusion 6241 extends in the first direction. The protrusion 6241 is located between the second portion 542 of the spacing lever 54 and the pressing member 55K in the state in which the developing cartridge 6K is mounted on the drum cartridge 5K.

9. Details of Image Forming Apparatus

There will be next described the details of the image forming apparatus 1 with reference to FIG. 21 to FIG. 28.

Figure 21:
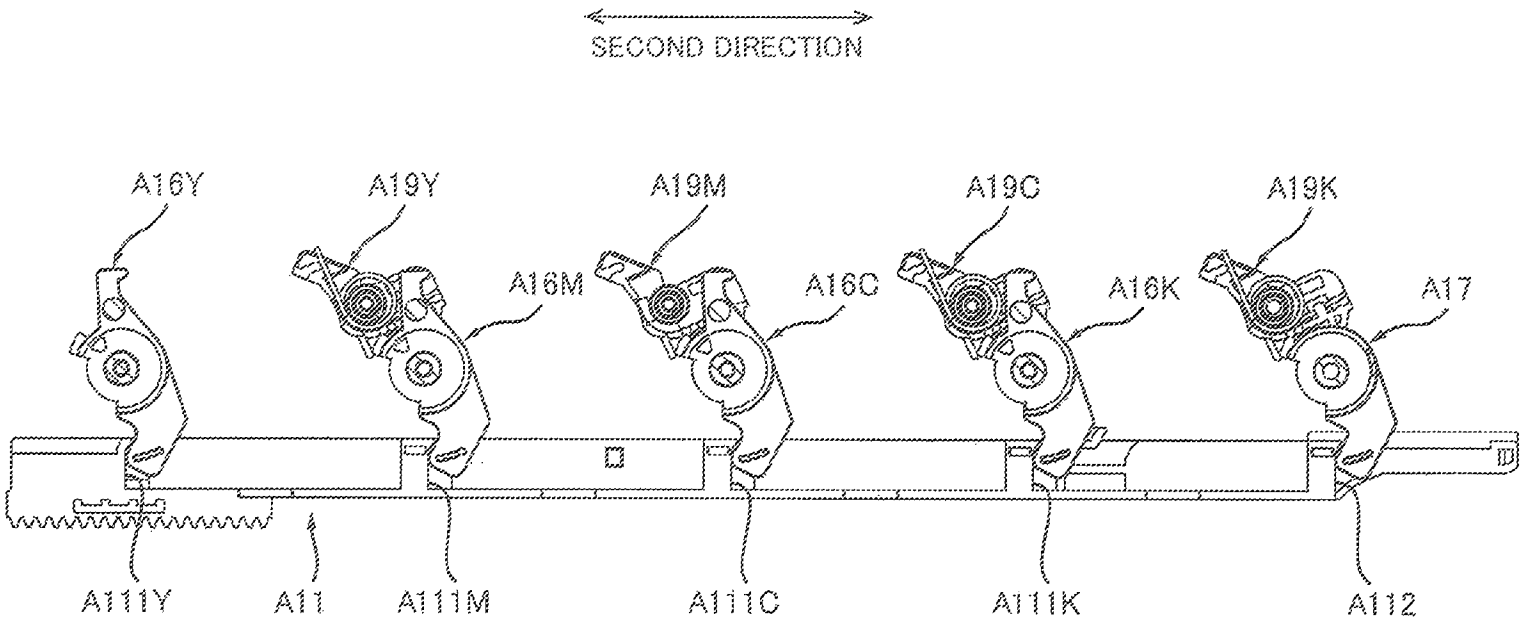
FIG. 21 is a side view of first rotating members, a second rotating member, lock members, and a cam included in the image forming apparatus illustrated in FIG. 1.

As illustrated in FIG. 21, the image forming apparatus 1 includes four first rotating members A16Y, A16M, A16C, A16K, a second rotating member A17, four lock members A19Y, A19M, A19C, A19K, and a cam A11.

9.1 Four First Rotating Members A16Y, A16M, A16C, A16K

The four first rotating members A16Y, A16M, A16C, A16K are supported by the housing 2. The four first rotating members A16Y, A16M, A16C, A16K are spaced apart from one another in the second direction. The second direction intersects the first direction and the vertical direction. The four first rotating members A16Y, A16M, A16C, A16K have the same structure as one another. Accordingly, the first rotating member A16K will be explained in detail, and explanation for the first rotating member A16Y, A16M, A16C is omitted.

9.1.1 First Rotating Member A16K

Figure 22:
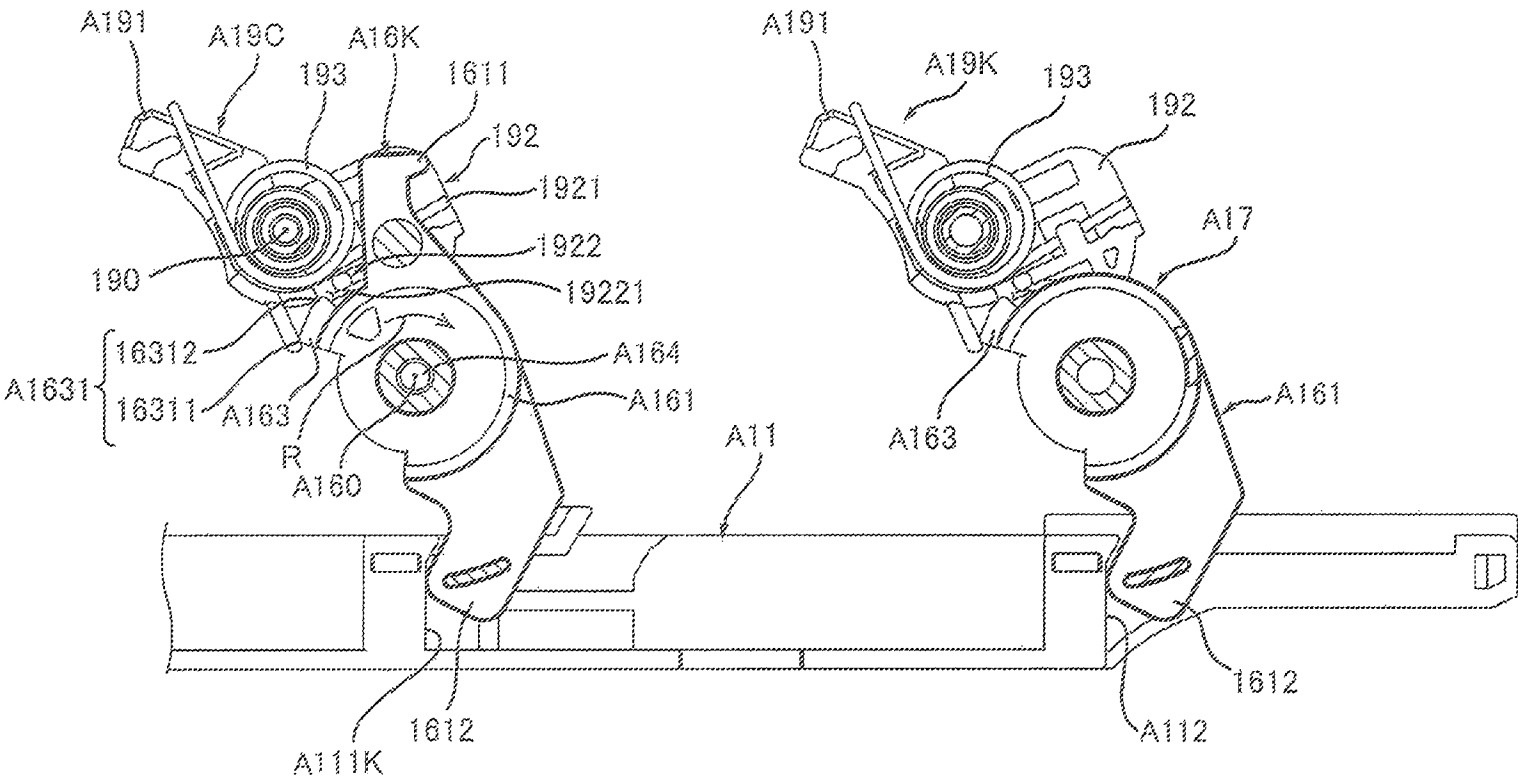
FIG. 22 is a one side view of the first rotating member and the second rotating member illustrated in FIG. 21, illustrating a state in which the first rotating members are located at a first position.

As illustrated in FIG. 22, the first rotating member A16K is rotatable about an axis A160 with respect to the housing 2. The axis A160 extends in the first direction. The first rotating member A16K moves the lock member A19C from the lock releasing position to the lock position by pushing the lock member A19C. It is noted that the first rotating member A16M moves the lock member A19Y from the lock releasing position to the lock position by pushing the lock member A19Y (see FIG. 21). The first rotating member A16C moves the lock member A19M from the lock releasing position to the lock position by pushing the lock member A19M (see FIG. 21).

The first rotating member A16K is movable among the first position (see FIG. 22), the second position (see FIG. 24), and the third position (see FIG. 27) with respect to the housing 2.

The first rotating member A16K causes the lock member A19C to be located at the lock releasing position and causes the developing roller 61K to be located at the contact position in a state in which the first rotating member A16K is located at the first position (see FIG. 22). The first rotating member A16K causes the lock member A19C to be located at the lock position and causes the developing roller 61K to be located at the contact position in a state in which the first rotating member A16K is located at the second position (see FIG. 24). The first rotating member A16K causes the lock member A19C to be located at the lock position and causes the developing roller 61K to be located at the spaced position in a state in which the first rotating member A16K is located at the third position (see FIG. 27).

Figure 23:
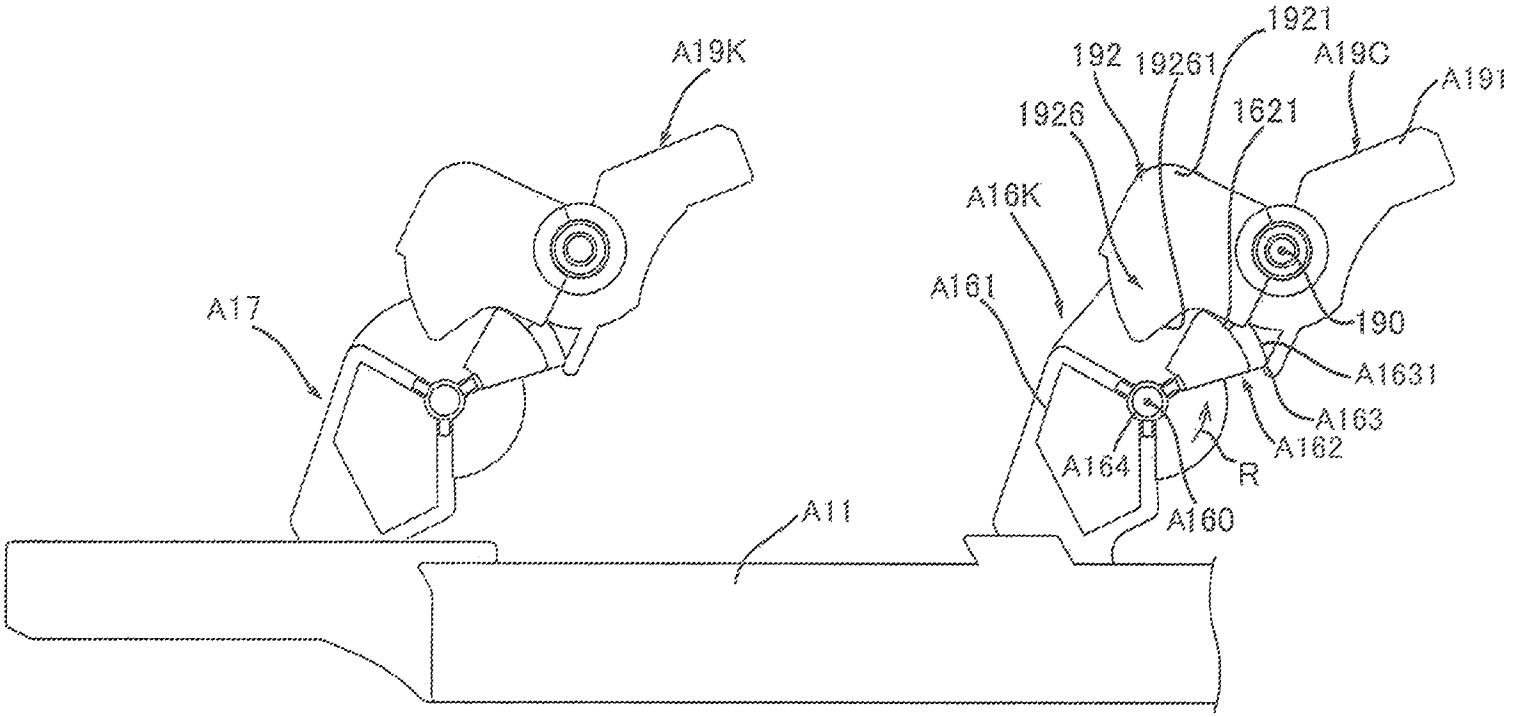
FIG. 23 is the other side view of the first rotating member and the second rotating member illustrated in FIG. 21, illustrating a state in which the first rotating members are located at the first position.

As illustrated in FIG. 22 and FIG. 23, the first rotating member A16K includes a body A161, a shaft A164, a cam portion A162, a protrusion A163, and a boss A165.

9.1.1.1 Body A161

The body A161 supports the shaft A164, the cam portion A162, and a boss, which is not illustrated. As illustrated in FIG. 22, the body A161 includes a first end portion 1611 and a second end portion 1612 spaced apart from the first end portion 1611.

9.1.1.2 Shaft A164

The shaft A164 extends along the axis A160. The shaft A164 is provided at a center of the body A161. The shaft A164 is rotatably supported by the housing 2.

9.1.1.3 Cam Portion A162

As illustrated in FIG. 23, the cam portion A162 protrudes from the body A161 in the first direction. The cam portion A162 is located between the shaft A164 and the first end portion 1611 of the body A161 (see FIG. 22). The cam portion A162 includes a first cam surface 1621. The first cam surface 1621 causes the lock member A19C to be located at the lock position. The lock member A19C will be explained later. The first cam surface 1621 is spaced apart from the shaft A164 in the radial direction of the shaft A164. The first cam surface 1621 is a peripheral surface of a cylindrical shape, and an axis of the peripheral surface is the axis A160. The first cam surface 1621 is located on a downstream side of the protrusion A163 in a rotation direction R in which the first rotating member A16K rotates from the first position to the second position.

9.1.1.4 Protrusion A163

The protrusion A163 protrudes from the cam portion A162 in the radial direction of the shaft A164. The radial direction is orthogonal to the axis A160. The protrusion A163 extends in the first direction. The protrusion A163 includes a second cam surface A1631. The second cam surface A1631 moves the lock member A19C from the lock releasing position toward the lock position (see FIG. 22 and FIG. 24). The second cam surface A1631 is spaced apart from the lock member A19C in a state in which the lock member A19C is located at the lock position (see FIG. 27). More specifically, the second cam surface A1631 moves the lock member A19C from the lock releasing position toward the lock position while the first rotating member A16K moves from the first position to the second position (see FIG. 22 and FIG. 24). The second cam surface A1631 is a part of a peripheral surface of a cylindrical shape, and an axis of the peripheral surface is the axis A160.

The second cam surface A1631 is spaced apart from the first cam surface 1621 in the radial direction of the shaft A164. The second cam surface A1631 is located between the first cam surface 1621 and the first end portion 1611 in the radial direction of the shaft A164. The second cam surface A1631 is located between a lock axis 190 of the lock member A19C and the first cam surface 1621. The second cam surface A1631 is located on an upstream side of the first cam surface 1621 in the rotation direction R in which the first rotating member A16K rotates from the first position to the second position. A dimension of the first cam surface 1621 in the first direction is larger than a dimension of the second cam surface A1631 in the first direction. Accordingly, the lock member A19C and the first cam surface 1621 can be in stable contact with each other in a state in which the lock member A19C is located at the lock position (see FIG. 28).

As illustrated in FIG. 22, the second cam surface A1631 includes an upstream side-surface 16311 and a downstream side-surface 16312. The upstream side-surface 16311 is located on an upstream side of the downstream side-surface 16312 in the rotation direction R. The downstream side-surface 16312 is located a downstream side of the upstream side-surface 16311 in the rotation direction R. A distance of the upstream side-surface 16311 from the axis A160 of the first rotating member A16K is larger than a distance of the downstream side-surface 16312 from the axis A160 of the first rotating member A16K.

Figure 24:
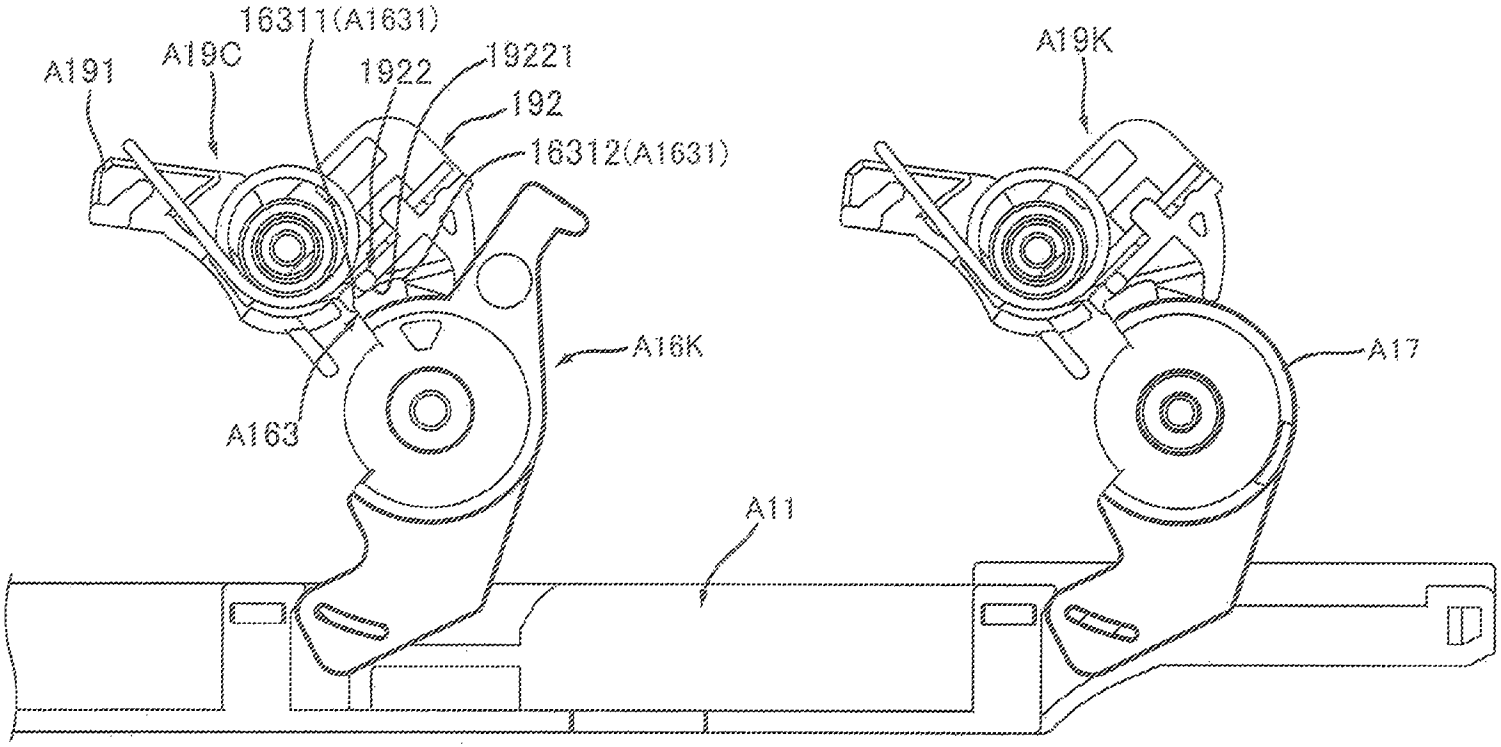
FIG. 24 is a one side view of the first rotating member and the second rotating member illustrated in FIG. 21, illustrating a state in which the first rotating members are located at a second position.
Figure 25:
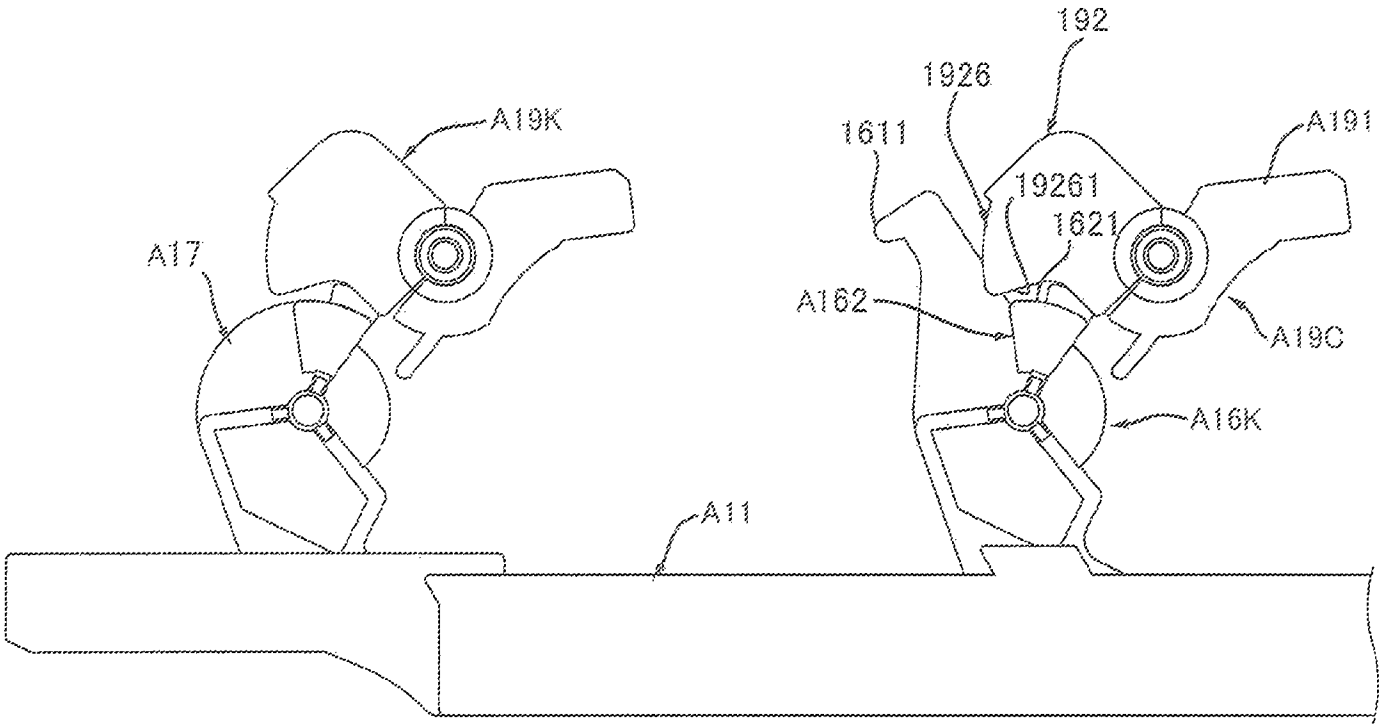
FIG. 25 is the other side view of the first rotating member and the second rotating member illustrated in FIG. 21, illustrating a state in which the first rotating members are located at the second position.

When the upstream side-surface 16311 is in contact with a second lock cam surface 19221 of the lock member A19C (see FIG. 24), a first lock cam surface 19261 of the lock member A19C is spaced apart from the first cam surface 1621 (see FIG. 25). When the first lock cam surface 19261 of the lock member A19C is in contact with the first cam surface 1621 (see FIG. 28), the downstream side-surface 16312 is spaced apart from the second lock cam surface 19221 of the lock member A19C (see FIG. 27). The first lock cam surface 19261 and the second lock cam surface 19221 will be explained later.

9.1.1.4 Boss A165

Figure 28:
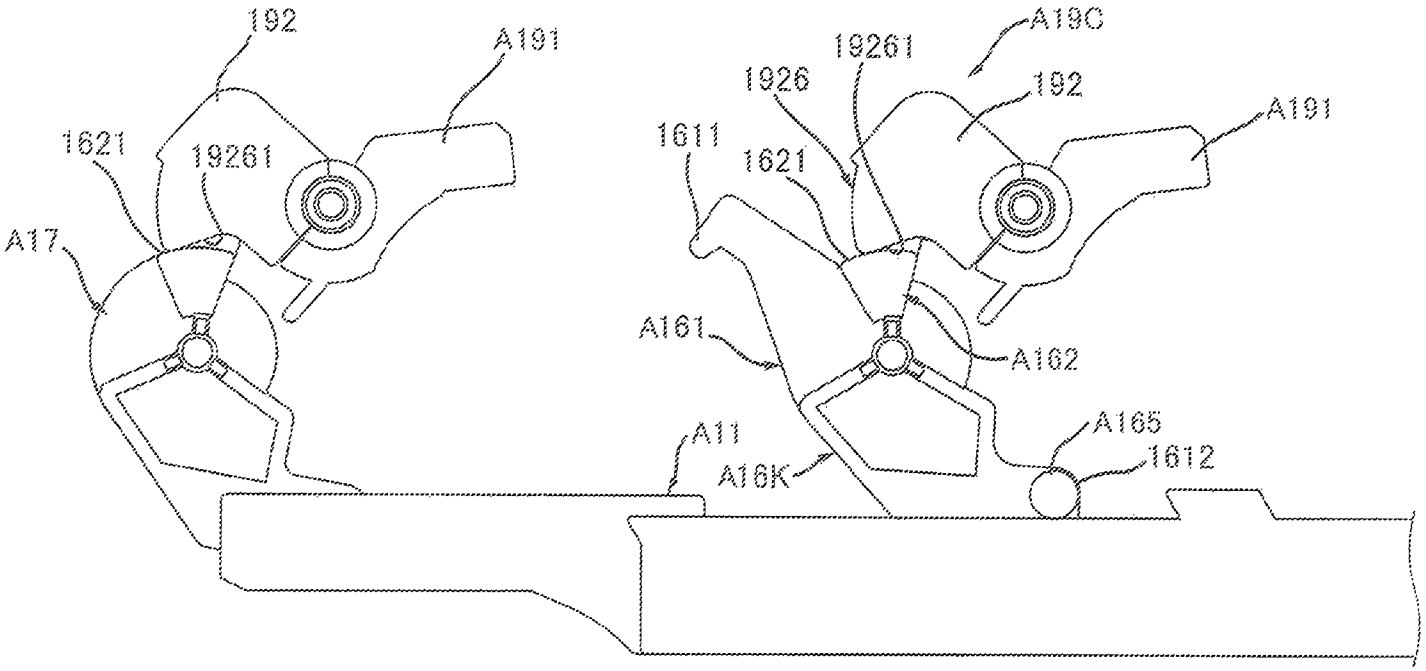
FIG. 28 is the other side view of the first rotating member and the second rotating member illustrated in FIG. 21, illustrating a state in which the first rotating members are located at the third position.

As illustrated in FIG. 28, the boss A165 is provided at the second end portion 1612 of the body A161. The boss A165 extends from the body A161 in the first direction. The boss A165 is in contact with the cam A11. The boss A165 is fitted into the first groove A111K in a state in which a first rotating member A16 is located at the first position or the second position, though not illustrated. The first groove A111K will be explained later. The boss A165 is in contact with an upper surface of the cam A11 in a state in which the first rotating member A16 is located at the third position.

9.2 Second Rotating Member A17

The second rotating member A17 is supported by the housing 2. The second rotating member A17 is located on the opposite side of the first rotating member A16C with respect to the first rotating member A16K in the second direction (see FIG. 21). The second rotating member A17 has the same structure as that of the first rotating member A16K except that the body A161 does not have the first end portion 1611. Therefore, explanation for the second rotating member A17 is omitted. The second rotating member A17 moves the lock member A19K from the lock releasing position to the lock position by pushing the lock member A19K.

9.3 Four Lock Members A19Y, A19M, A19C, A19K

As illustrated in FIG. 21, the four lock members A19Y, A19M, A19C, A19K are supported by the housing 2. The four lock members A19Y, A19M, A19C, A19K are spaced apart from one another in the second direction. The four lock members A19Y, A19M, A19C, A19K have the same structure as one another. Therefore, the lock member A19C will be explained in detail, and explanation for the lock members A19Y, A19M, A19K is omitted 9.3.1 Lock Member A19C As illustrated in FIG. 22 and FIG. 24, the lock member A19C is movable between the lock releasing position (see FIG. 22) and the lock position (see FIG. 24). The lock member A19C locks the photoconductive drum 51C to the housing 2 in a state in which the lock member A19C is located at the lock position. The lock of the photoconductive drum 51C with respect to the housing 2 is released in a state in which the lock member A19C is located at the lock releasing position.

As illustrated in FIG. 22, the lock member A19C is rotatable about the lock axis 190 between the lock position and the lock releasing position. The lock axis 190 extends in the first direction. The lock axis 190 of the lock member A19Y is spaced apart from the axis A160 of the first rotating member A16Y. The lock axis 190 is located at an upper position than the axis A160 of the first rotating member A16Y.

The lock member A19C includes the lock arm A191, a lock lever 192, and a spring 193.

9.3.1.1 Lock Arm A191

The lock arm A191 is supported by the housing 2. The lock arm A191 is rotatable about the lock axis 190.

As illustrated in FIG. 24, the lock member A19C is located at the lock position in a state in which the drum cartridge 5C is mounted on the housing 2 and the first rotating member A16K is located at the second position or the third position. The lock arm A191 is in contact with the protrusion A5312 of the drum cartridge 5C in a state in which the lock member A19C is located at the lock position (see FIG. 19). Accordingly, it is possible to stably lock the photoconductive drum 51C to the housing 2 in the state in which the lock member A19C is located at the lock position. It is noted that the drum cartridge 5C is not mountable/detachable on/from the housing 2 in a state in which the first rotating member A16K is located at the second position or the third position (see FIG. 1).

As illustrated in FIG. 22, the lock member A19C is located at the lock releasing position in a state in which the drum cartridge 5C is mounted on the housing 2 and the first rotating member A16K is located at the first position. The lock arm A191 is spaced apart from the protrusion A5312 of the drum cartridge 5C in a state in which the lock member A19C is located at the lock position (see FIG. 19). Accordingly, the drum cartridge 5C is mountable/detachable on/from the housing 2 in a state in which the first rotating member A16K is located at the first position (see FIG. 2).

9.3.1.2 Lock Lever 192

The lock lever 192 is supported by the lock arm A191. The lock lever 192 and the body A161 of the first rotating member A16K are arranged in the first direction. The lock lever 192 is rotatable about the lock axis 190. The lock lever 192 includes a body 1921, a lock cam 1926 (see FIG. 23), a first rib 1923 (see FIG. 27), a second rib 1924 (see FIG. 27), and a boss 1922.

The body 1921 extends in a direction orthogonal to the lock axis 190. The body 1921 supports the lock cam 1926, the first rib 1923, and the second rib 1924.

As illustrated in FIG. 23, the lock cam 1926 protrude downward from the body 1921. The lock cam 1926 includes the first lock cam surface 19261. In other words, the lock member A19C includes the first lock cam surface 19261. The first lock cam surface 19261 opposes to the cam portion A162 of the first rotating member A16K in the rotation direction R in a state in which the first rotating member A16K is located at the first position. The first lock cam surface 19261 is in contact with the first cam surface 1621 of the first rotating member A16K in a state in which the first rotating member A16K is located at the third position (see FIG. 28).

Figure 27:
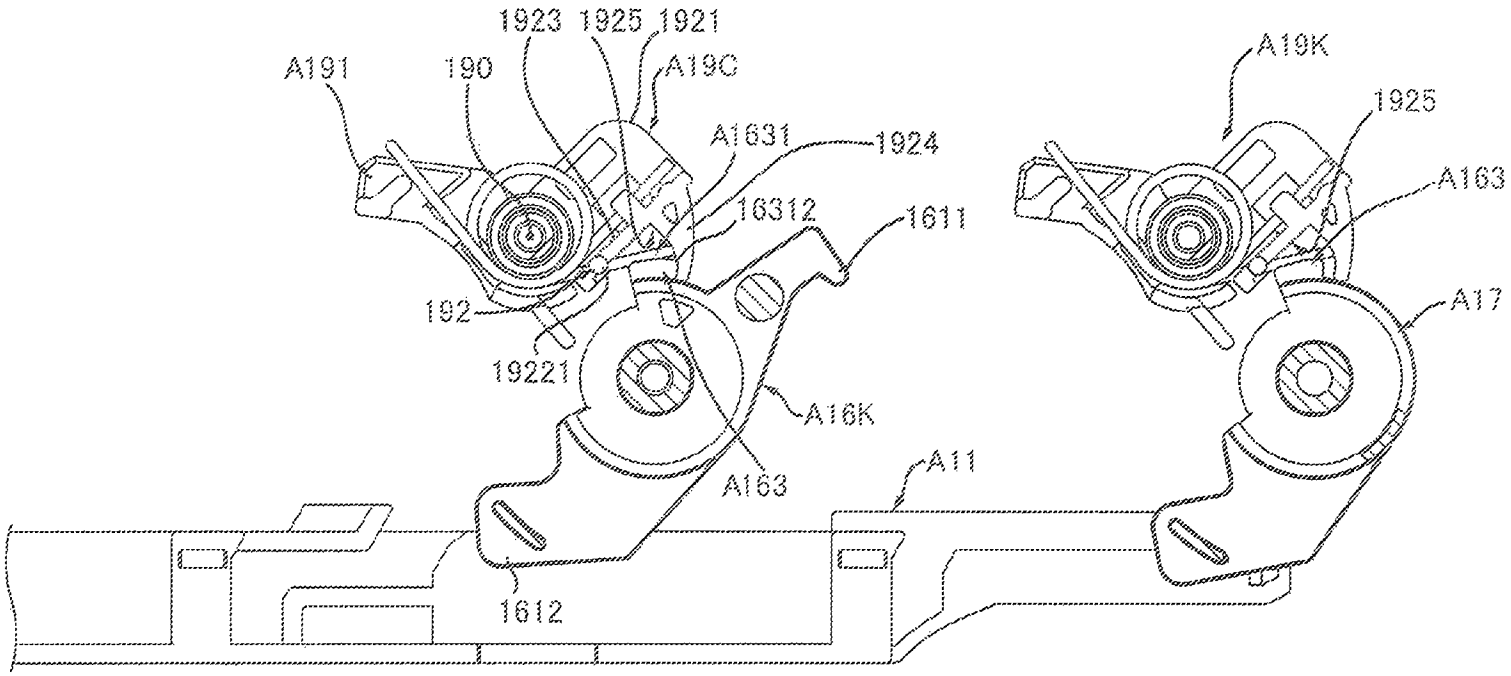
FIG. 27 is a one side view of the first rotating member and the second rotating member illustrated in FIG. 21, illustrating a state in which the first rotating members are located at a third position.

As illustrated in FIG. 27, the first rib 1923 protrudes from the body 1921 in the first direction. The first rib 1923 extends in a direction in which the body 1921 extends. The second rib 1924 is located on the opposite side of the lock axis 190 with respect to the first rib 1923. The second rib 1924 protrudes from the first rib 1923 in a direction intersecting a direction in which the first rib 1923 extends. The first rib 1923 and the second rib 1924 are constituting a recessed portion 1925. In other words, the lock member A19C includes the recessed portion 1925. The recessed portion 1925 accommodates the protrusion A163 in a state in which the first rotating member A16K is located at the second position or the third position. Therefore, it is possible to reduce the image forming apparatus 1 in size.

The boss 1922 is provided at the first rib 1923. The boss 1922 is located on the opposite side of the body 1921 with respect to the first rib 1923 in the first direction. The boss 1922 extends from the first rib 1923 in the first direction. The boss 1922 is spaced apart from the second rib 1924. The boss 1922 includes the second lock cam surface 19221. In other words, the lock member A19C includes the second lock cam surface 19221. The second lock cam surface 19221 comes into contact with the second cam surface A1631 of the first rotating member A16K when the first rotating member A16K rotates from the first position to the second position (see FIG. 24). The second lock cam surface 19221 is a part of a peripheral surface of the boss 1922.

9.3.1.3 Spring 193

As illustrated in FIG. 22, the spring 193 is, specifically, a torsion spring. One end of the spring 193 is supported by the lock arm A191. The other end of the spring 193 is supported by the lock lever 192.

9.5 Cam A11

As illustrated in FIG. 21, the cam A11 moves the four first rotating members A16Y, A16M, A16C, A16K and the second rotating member A17, as a group, by contacting the four first rotating members A16Y, A16M, A16C, A16K and the second rotating member A17 (see FIG. 22 to FIG. 28). The cam A11 extends in the second direction.

The cam A11 includes four first groove A111Y, A111M, A111C, A111K and a second groove A112.

The four first grooves A111Y, A111M, A111C, A111K is located on a side surface of the cam A11 in the first direction. The four first grooves A111Y, A111M, A111C, A111K are arranged in order in the second direction. Each of the four first grooves A111Y, A111M, A111C, A111K is recessed in the first direction. A boss of the first rotating member A16Y is fitted into the first groove A111Y A boss of the first rotating member A16M is fitted into the first groove A111M. A boss of the first rotating member A16C is fitted into the first groove A111C. A boss of the first rotating member A16K is fitted into the first groove A111K. Dimensions of the first grooves A111Y, A111M, A111C in the second direction are the same as one another. A dimension of the first groove A111K in the second direction is larger than the dimension of the first grooves A111Y in the second direction.

The second groove A112 is located on a side surface of the cam A11 in the first direction. The second groove A112 is located on the opposite side of the first groove A111C with respect to the first groove A111K in the second direction. The second groove A112 is recessed in the first direction. A boss of the second rotating member A17 is fitted into the second groove A112.

The cam A11 is movable among a cam first position (see FIG. 22), a cam second position (see FIG. 24), a cam third position (see FIG. 26), and a cam fourth position (see FIG. 27) in the second direction.

As illustrated in FIG. 22, the cam A11 is located at the cam first position in a state in which the cover 3 is located at the open position. Each of the four first rotating members A16Y, A16M, A16C, A16K and the second rotating member A17 is located at the first position in a state in which the cam A11 is located at the cam first position. Accordingly, each of the four lock members A19Y, A19M, A19C, A19K is located at the lock releasing position, and each of the four developing rollers 61Y, 61M, 61C, 61K is located at the contact position.

As illustrated in FIG. 24, the cam A11 is movable from the cam first position to the cam fourth position via the cam second position and the cam third position in a state in which the cover 3 is located at the closed position. When the cam A11 moves from the cam first position to the cam second position, each of the four first rotating members A16Y, A16M, A16C, A16K and the second rotating member A17 moves from the first position to the second position. Accordingly, each of the four lock members A19Y, A19M, A19C, A19K moves from the lock releasing position to the lock position, and each of the four developing rollers 61Y, 61M, 61C, 61K is maintained at the contact position.

Figure 26:
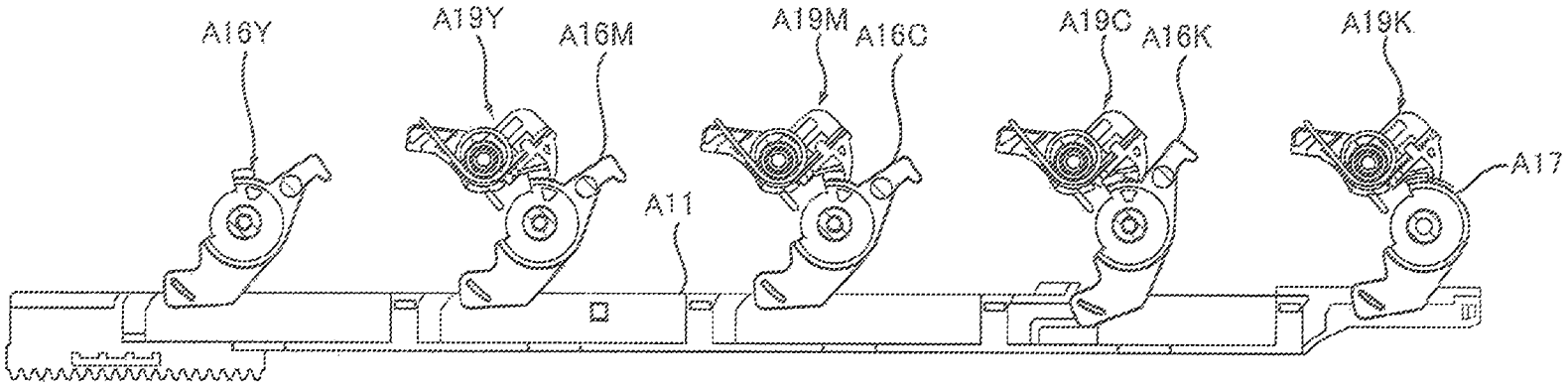
FIG. 26 is a one side view of the first rotating members and the second rotating member illustrated in FIG. 21, illustrating a state in which the three first rotating members are located at the second position and the one first rotating member is located at the first position.

As illustrated in FIG. 26, when the cam A11 moves from the cam second position to the cam third position, each of the three first rotating members A16Y, A16M, A16C moves from the second position to the third position, and each of the first rotating member A16K and the second rotating member A17 is maintained at the second position. At this time, each of the four lock members A19Y, A19M, A19C, A19K is maintained at the lock position, each of the three developing rollers 61Y, 61M, 61C moves from the contact position to the spaced position, and the developing roller 61K is maintained at the contact position.

As illustrated in FIG. 27, when the cam A11 moves from the cam third position to the cam fourth position, each of the three first rotating members A16Y, A16M, A16C is maintained at the third position, each of the first rotating member A16K and the second rotating member A17 moves from the second position to the third position. At this time, each of the four lock members A19Y, A19M, A19C, A19K is maintained at the lock position, each of the three developing rollers 61Y, 61M, 61C is maintained at the spaced position, and the developing roller 61K moves from the contact position to the spaced position.

9.6 Details of Operations of Rotating Members

There will be next described the details of operations of the rotating members by the first rotating member A16K as a representative of the four first rotating members A16Y, A16M, A16C, A16K.

As illustrated in FIG. 22 and FIG. 23, in a state in which the first rotating member A16K is located at the first position, the first cam surface 1621 of the first rotating member A16K is spaced apart from the first lock cam surface 19261 of the lock member A19C, and the second cam surface A1631 of the first rotating member A16K is spaced apart from the second lock cam surface 19221 of the lock member A19C. In this state, the spring 193 holds the lock arm A191 such that the lock arm A191 is spaced apart from the protrusion A5312 of the drum cartridge 5C. Accordingly, the lock member A19C is located at the lock releasing position.

When the first rotating member A16K is located at the first position, the first end portion 1611 of the first rotating member A16K is spaced apart from the first portion 541 of the spacing lever 54K of the drum cartridge 5K (see FIG. 19). The first rotating member A16K causes the developing roller 61K to be located at the contact position in a state in which the first rotating member A16K is located at the first position (see FIG. 3A).

As illustrated in FIG. 24 and FIG. 25, while the first rotating member A16K moves from the first position to the second position, the second cam surface A1631 of the first rotating member A16K comes into contact with the second lock cam surface 19221 of the lock member A19C in a state in which the first cam surface 1621 of the first rotating member A16K is spaced apart from the first lock cam surface 19261 of the lock member A19C. Accordingly, the lock lever 192 is pushed by the protrusion A163, and the lock member A19C is rotated from the lock releasing position toward the lock position.

At this time, the first end portion 1611 of the first rotating member A16K is spaced apart from the first portion 541 of the spacing lever 54K (see FIG. 19), and the developing roller 61K is maintained at the contact position (see FIG. 3A).

Moreover, the first rotating member A16K is movable from the second position toward the third position in a state in which the second cam surface A1631 is in contact with the second lock cam surface 19221. Therefore, the first rotating member A16K can move from the second position to the third position in a state in which the lock member A19C is maintained at the lock position.

As illustrated in FIG. 27 and FIG. 28, while the first rotating member A16K moves from the second position to the third position, the second cam surface A1631 of the first rotating member A16K goes away from the second lock cam surface 19221 of the lock member A19C, and the first cam surface 1621 of the first rotating member A16K comes into contact with the first lock cam surface 19261 of the lock member A19C. Accordingly, the lock member A19C is maintained at the lock position.

When the first rotating member A16K moves from the second position to the third position, the first end portion 1611 pushes the first portion 541 of the spacing lever 54K. Then, the spacing lever 54K rotates, and the second portion 542 of the spacing lever 54K pushes the protrusion 6241 of the support portion A624 so as to be spaced apart from the photo conductive drum 51K (see FIG. 20). Accordingly, the first rotating member A16K causes the developing roller 61K to be located at the spaced position in a state in which the first rotating member A16K is located at the third position (see FIG. 3B).

10. Operation and Effect

As illustrated in FIG. 22, in the image forming apparatus 1, the protrusion A163 included in the first rotating member A16K protrudes from the cam portion A162 in the radial direction of the shaft A164, and includes the second cam surface A1631. And, as illustrated in FIG. 24, the second cam surface A1631 of the protrusion A163 moves the lock member A19C from the lock releasing position to the lock position by pushing the lock member A19C. Accordingly, it is possible to reduce operation load occurred when the lock member A19C is moved from the lock releasing position toward the lock position.

Moreover, the cam portion A162 included in the first rotating member A16K includes the first cam surface 1621. And as illustrated in FIG. 28, the first cam surface 1621 of the cam portion A162 causes the lock member A19C to be located at the lock position. Accordingly, it is possible to improve a stability of the lock member A19C located at the lock position as compared with a case where the second cam surface A1631 causes the lock member A19C to be located at the lock position.

What is claimed is:

1. An image forming apparatus, comprising:

a housing;

a drum cartridge including a photoconductive drum;

a developing cartridge including a developing roller and movable between a contact position at which the developing roller contacts the photoconductive drum and a spaced position at which the developing roller is spaced apart from the photoconductive drum;

a first spacing member movable with respect to the housing, the first spacing member being configured to move the developing cartridge between the contact position and the spaced position;

a first cam configured to move the first spacing member; and a lock member movable between a lock position at which the photoconductive drum is locked to the housing and a lock releasing position at which the lock of the photoconductive drum with respect to the housing is released, the lock member being configured to move from the lock releasing position to the lock position by being pushed by the first spacing member.

2. The image forming apparatus according to claim 1, wherein the first spacing member is rotatable about a first axis between a first position at which the developing cartridge is located at the contact position and a second position at which the developing cartridge is located at the spaced position, wherein the lock member is rotatable about a second axis between the lock position and the lock releasing position, and wherein a rotation direction in which the first spacing member moves from the first position to the second position is the same as a rotation direction in which the lock member moves from the lock releasing position to the lock position.

3. The image forming apparatus according to claim 2, wherein the second axis is spaced apart from the first axis.

4. The image forming apparatus according to claim 3, wherein the second axis is located at a lower position than the first axis.

5. The image forming apparatus according to claim 1, wherein the photoconductive drum is rotatable about a drum axis extending in a first direction, and wherein the lock member includes a first protrusion extending in the first direction and contacting the drum cartridge in the state in which the lock member is located at the lock position.

6. The image forming apparatus according to claim 5, wherein the housing includes a guide guiding mounting/detachment of the drum cartridge on/from the housing, and wherein the lock member includes a body supporting the first protrusion and located on the opposite side of the photoconductive drum with respect to the guide in the first direction in a state in which the drum cartridge is mounted on the housing.

7. The image forming apparatus according to claim 6, wherein the first protrusion is constituting a part of the guide in a state in which the lock member is located at the lock releasing position.

8. The image forming apparatus according to claim 5, wherein the first protrusion is configured to move in a vertical direction when the lock member moves between the lock position and the lock releasing position.

9. The image forming apparatus according to claim 5, wherein the drum cartridge includes a second protrusion extending in the first direction and contacting the first protrusion in the state in which the lock member is located at the lock position.

10. The image faulting apparatus according to claim 1, further comprising:

a second spacing member located on an opposite side of the first spacing member with respect to the developing cartridge in a first direction in which a drum axis of the photoconductive drum extends, the second spacing member being configured to move the developing cartridge between the contact position and the spaced position together with the first spacing member; and a second cam located on the opposite side of the first cam with respect to the developing cartridge in the first direction, the second cam being configured to move the second spacing member by contacting the second spacing member, wherein the first cam is located at an upper position than the second cam, and wherein the lock member is located between the first cam and the second cam in a vertical direction.

11. The image forming apparatus according to claim 1, wherein the first spacing member is rotatable, with respect to the housing, about an axis extending in a first direction and is configured to move the lock member from the lock releasing position to the lock position by pushing the lock member, and wherein the first spacing member includes:

a cam portion having a first cam surface configured to cause the lock member to be located at the lock position;

a protrusion protruding in a radial direction orthogonal to the axis of the first spacing member and including a second cam surface configured to move the lock member from the lock releasing position toward the lock position, the second cam surface being spaced apart from the lock member in the state in which the lock member is located at the lock position.

12. The image forming apparatus according to claim 11, wherein the first spacing member is movable, with respect to the housing, among (i) a first position at which the first spacing member causes the lock member to be located at the lock releasing position and causes the developing cartridge to be located at the contact position, (ii) a second position at which the first spacing member causes the lock member to be located at the lock position and causes the developing cartridge to be located at the contact position, and (iii) a third position at which the first spacing member causes the lock member to be located at the lock position and causes the developing cartridge to be located at the spaced position, and wherein the second cam surface is configured to move the lock member from the lock releasing position toward the lock position in the middle of the movement of the first spacing member from the first position to the second position.

13. The image forming apparatus according to claim 12, wherein the drum cartridge is mountable/detachable on/from the housing in a state in which the first spacing member is located at the first position, and wherein the drum cartridge is not mountable/detachable on/from the housing in a state in which the first spacing member is located at the second position or the third position.

14. The image forming apparatus according to claim 12, wherein the second cam surface is located at an upstream side of the first cam surface in a rotation direction in which the first spacing member rotates from the first position to the second position.

15. The image forming apparatus according to claim 12, wherein the lock member including a recessed portion accommodating the protrusion in a state in which the first spacing member is located at the second position or the third position.

16. The image forming apparatus according to claim 12, wherein the lock member includes:

a first lock cam surface configured to contact the first cam surface of the first spacing member; and a second lock cam surface configured to contact the second cam surface of the first spacing member.

17. The image forming apparatus according to claim 16, wherein the second cam surface includes:

an upstream side-surface located at an upstream side in a rotation direction in which the first spacing member rotates from the first position to the second position; and a downstream side-surface at a downstream side in the rotation direction in which the first spacing member rotates from the first position to the second position, wherein the first lock cam surface of the lock member is spaced apart from the first cam surface in a state in which the upstream side-surface is in contact with the second lock cam surface of the lock member, and wherein the downstream side-surface is spaced apart from the second lock cam surface of the lock member in a state in which the first lock cam surface of the lock member is in contact with the first cam surface.

18. The image forming apparatus according to claim 17, wherein a distance from the axis of the first spacing member to the upstream side-surface is larger than a distance from the axis of the first spacing member to the downstream side-surface.

19. The image forming apparatus according to claim 11, wherein a dimension of the first cam surface in a direction in which the axis of the first spacing member extends is larger than that of the second cam surface.

20. The image forming apparatus according to claim 11, wherein the first cam surface is a part of a peripheral surface of a cylindrical shape, and an axis of the peripheral surface is the axis of the first spacing member.

21. An image forming apparatus, comprising:

a housing;

a drum cartridge including a photoconductive drum;

a developing cartridge including a developing roller and movable between a contact position at which the developing roller contacts the photoconductive drum and a spaced position at which the developing roller is spaced apart from the photoconductive drum;

a spacing cam movable with respect to the housing, the spacing cam being configured to move the developing cartridge between the contact position and the spaced position, the spacing cam including a protrusion which has a spacing cam surface;

a moving cam configured to move the spacing cam; and a lock member movable between a lock position at which the photoconductive drum is locked to the housing and a lock releasing position at which the lock of the photoconductive drum with respect to the housing is released, the lock member having a lock surface, the lock member being configured to move from the releasing position to the lock position when the spacing cam surface of the spacing cam pushes the lock surface of the lock member.

22. The image forming apparatus according to claim 21, wherein the spacing cam is rotatable about a first axis between a first position at which the developing cartridge is located at the contact position and a second position at which the developing cartridge is located at the spaced position, wherein the lock member is rotatable about a second axis between the lock position and the lock releasing position, and wherein a rotation direction in which the spacing cam moves from the first position to the second position is the same as a rotation direction in which the lock member moves from the lock releasing position to the lock position.

23. The image forming apparatus according to claim 21, wherein the photoconductive drum is rotatable about a drum axis extending in a first direction, and wherein the lock member includes a first protrusion extending in the first direction and contacting the drum cartridge in the state in which the lock member is located at the lock position.

24. The image forming apparatus according to claim 21, further comprising:

a second spacing cam different from the spacing cam as a first spacing cam and located on the opposite side of the first spacing cam with respect to the developing cartridge in a first direction in which a drum axis of the photoconductive drum extends, the second spacing cam being configured to move the developing cartridge between the contact position and the spaced position together with the first spacing cam; and a second moving cam different from the moving cam as a first moving cam and located on the opposite side of the first moving cam with respect to the developing cartridge in the first direction, the second moving cam being configured to move the second spacing cam by contacting the second spacing cam, wherein the first moving cam is located at an upper position than the second moving cam, and wherein the lock member is located between the first moving cam and the second moving cam in a vertical direction.

25. The image forming apparatus according to claim 21, wherein the first spacing cam is rotatable, with respect to the housing, about an axis extending in a first direction and is configured to move the lock member from the lock releasing position to the lock position by pushing the lock member, and wherein the first spacing cam includes:

a cam portion having a first cam surface configured to cause the lock member to be located at the lock position;

a protrusion protruding in a radial direction orthogonal to the axis of the first spacing cam and including a second moving cam surface configured to move the lock member from the lock releasing position toward the lock position, the second cam surface being spaced apart from the lock member in the state in which the lock member is located at the lock position.

* * * * *